US010436527B2

(12) United States Patent
Jindou et al.

(10) Patent No.: US 10,436,527 B2
(45) Date of Patent: Oct. 8, 2019

(54) REFRIGERANT DIVERTER

(71) Applicant: DAIKIN INDUSTRIES, LTD., Osaka-shi, Osaka (JP)

(72) Inventors: Masanori Jindou, Settsu (JP); Yoshio Oritani, Settsu (JP); Yoshimasa Kikuchi, Sakai (JP); Tomohiko Sakamaki, Sakai (JP); Junichi Hamadate, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 57 days.

(21) Appl. No.: 15/518,208

(22) PCT Filed: Oct. 8, 2015

(86) PCT No.: PCT/JP2015/078653

§ 371 (c)(1),
(2) Date: Apr. 10, 2017

(87) PCT Pub. No.: WO2016/060064

PCT Pub. Date: Apr. 21, 2016

(65) Prior Publication Data

US 2017/0299284 A1 Oct. 19, 2017

(30) Foreign Application Priority Data

Oct. 16, 2014 (JP) ..... 2014-211981

(51) Int. Cl.
*F28F 9/02* (2006.01)
*F25B 13/00* (2006.01)
(Continued)

(52) U.S. Cl.
CPC ..... *F28F 9/0273* (2013.01); *F25B 13/00* (2013.01); *F25B 39/00* (2013.01); *F25B 39/028* (2013.01);
(Continued)

(58) Field of Classification Search
CPC ..... F28F 9/026; F28F 9/027; F28F 9/0273; F28F 9/028; F25B 39/00; F25B 39/028; F25B 39/04
(Continued)

(56) References Cited

U.S. PATENT DOCUMENTS 3,976,128 A * 8/1976 Patel ..... F25B 39/02 165/153
4,524,823 A * 6/1985 Hummel ..... F25B 39/028 165/174
(Continued)

FOREIGN PATENT DOCUMENTS

GB 2 250 336 A 6/1992
JP 4-302964 A 10/1992
(Continued)

OTHER PUBLICATIONS

International Preliminary Report of corresponding PCT Application No. PCT/JP2015/078653 dated Apr. 27, 2017.
(Continued)

*Primary Examiner* — Tho V Duong
(74) *Attorney, Agent, or Firm* — Global IP Counselors, LLP

(57) ABSTRACT

A refrigerant diverter diverts inflowing refrigerant and to cause the refrigerant to flow out to a downstream side. The refrigerant diverter includes a vertically extending diverter case, and a vertically extending rod-shaped rod member disposed inside the diverter case. The diverter case has a plurality of diverting channels disposed along a circumferential direction, a diverting space arranged to guide the refrigerant to the diverting channels, and a plurality of expelling spaces that communicate with the diverting space through the diverting channels, the expelling spaces being disposed along a vertical direction. The diverting channels are configured from a plurality of holes extending in a longitudinal direction of the rod member and integrally formed in the rod member.

10 Claims, 25 Drawing Sheets

(51) Int. Cl.

| | |
|---|---|
| ***F25B 39/00*** | (2006.01) |
| ***F25B 39/02*** | (2006.01) |
| ***F28D 1/047*** | (2006.01) |
| ***F28D 1/053*** | (2006.01) |
| ***F28F 1/12*** | (2006.01) |
| ***F28F 1/32*** | (2006.01) |
| *F28D 21/00* | (2006.01) |

(52) U.S. Cl.
CPC ..... *F28D 1/047* (2013.01); *F28D 1/05391* (2013.01); *F28F 1/126* (2013.01); *F28F 1/32* (2013.01); *F28F 9/026* (2013.01); *F28F 9/027* (2013.01); *F28F 9/028* (2013.01); *F28F 9/0212* (2013.01); *F28F 9/0275* (2013.01); *F25B 2500/01* (2013.01); *F28D 2021/0068* (2013.01); *F28D 2021/0071* (2013.01); *F28F 2215/12* (2013.01)

(58) Field of Classification Search
USPC ..... 165/132, 174
See application file for complete search history.

(56) References Cited

U.S. PATENT DOCUMENTS 5,651,268 A * 7/1997 Aikawa ..... F25B 39/028 138/44
5,901,785 A * 5/1999 Chiba ..... F28D 1/0341 165/153
6,161,616 A * 12/2000 Haussmann ..... B60H 1/3227 165/152
6,179,051 B1 * 1/2001 Ayub ..... F28D 9/005 137/561 A
6,199,401 B1 * 3/2001 Haussmann ..... F25B 39/028 165/153
2003/0010483 A1 * 1/2003 Ikezaki ..... F28F 3/083 165/174
2012/0111547 A1 5/2012 Suzuki et al.
2014/0338874 A1 11/2014 Jindou et al.
2015/0184908 A1 7/2015 Suzuki et al.

FOREIGN PATENT DOCUMENTS

JP 4-316785 A 11/1992
JP 2012-102900 A 5/2012
JP 2013-130386 A 7/2013

OTHER PUBLICATIONS

International Search Report of corresponding PCT Application No. PCT/JP2015/78653 dated Dec. 15, 2015.
European Search Report of corresponding EP Application No. 15 85 0703.8 dated May 25, 2018.

* cited by examiner

REFRIGERANT DIVERTER

CROSS-REFERENCE TO RELATED APPLICATIONS

This U.S. National stage application claims priority under 35 U.S.C. § 119(a) to Japanese Patent Application No. 2014-211981, filed in Japan on Oct. 16, 2014, the entire contents of which are hereby incorporated herein by reference.

TECHNICAL FIELD

The present invention relates to a refrigerant diverter, and particularly to a refrigerant diverter having formed therein a plurality of diverting channels disposed along a circumferential direction inside a vertically extending diverter case.

BACKGROUND ART

In the past, there have been distributors (refrigerant diverters) having formed therein a plurality of distribution passages (diverting channels) disposed along a circumferential direction inside a vertically extending external pipe (diverter case), as is shown in Japanese Laid-open Patent Publication No. 4-316785. In these refrigerant diverters, the plurality of diverting channels are formed by the interior of an internal pipe, which is disposed inside the diverter case, being partitioned by partitioning bodies.

SUMMARY

Because the prior-art diverter described above employs a structure in which a plurality of diverting channels are formed by partitioning with partitioning bodies, there is a large number of components and it is difficult to improve producibility.

An object of the present invention is to adopt a structure in which a plurality of diverting channels can be formed with a small number of components in a refrigerant diverter in which a plurality of diverting channels disposed along a circumferential direction are formed inside a vertically extending diverter case, and improve producibility.

A refrigerant diverter according to a first aspect is a refrigerant diverter for diverting inflowing refrigerant and causing the refrigerant to flow out to a downstream side, a vertically extending diverter case having formed therein a plurality of diverting channels disposed along a circumferential direction, a diverting space for guiding the refrigerant to the diverting channels, and a plurality of expelling spaces communicating with the diverting space through the diverting channels and disposed along a vertical direction. A vertically extending rod-shaped rod member is disposed inside the diverter case, and the plurality of diverting channels are configured from a plurality of holes extending in the longitudinal direction of the rod member and integrally formed in the rod member.

According to the aspect described above, due to the rod member, in which the plurality of diverting channels are integrally formed, being disposed inside the diverter case, it is possible to obtain a structure enabling the plurality of diverting channels to be formed with a small number of components, and the producibility of the refrigerant diverter can thereby be improved.

A refrigerant diverter according to a second aspect is the refrigerant diverter according to the first aspect, wherein a plurality of rod-side surface holes are formed in a side surface of the rod member, and the expelling spaces and the diverting channels communicate through the rod-side surface holes.

A refrigerant diverter according to a third aspect is the refrigerant diverter according to the second aspect, wherein the rod-side surface holes are disposed in a helical array along the longitudinal direction of the rod member.

A refrigerant diverter according to a fourth aspect is the refrigerant diverter according to any of the first through third aspects, wherein a plurality of rod through-baffles, in which rod through-holes are formed for the rod member to pass through, are inserted into the diverter case from a side surface of the diverter case, and the expelling spaces are formed by the rod through-baffles.

A refrigerant diverter according to a fifth aspect is the refrigerant diverter according to any of the first through fourth aspects, wherein the diverting channels and the expelling spaces have a one-to-one correspondence with each other.

DESCRIPTION OF EMBODIMENTS

An embodiment and modifications of a diverter according to the present invention are described on the basis of the drawings. The specific configuration of the refrigerant diverter according to the present invention is not limited to the following embodiments or modifications, and can be altered within a range that does not deviate from the scope of the invention.

(1) Basic Configuration of the Air Conditioning Apparatus

Figure 1:
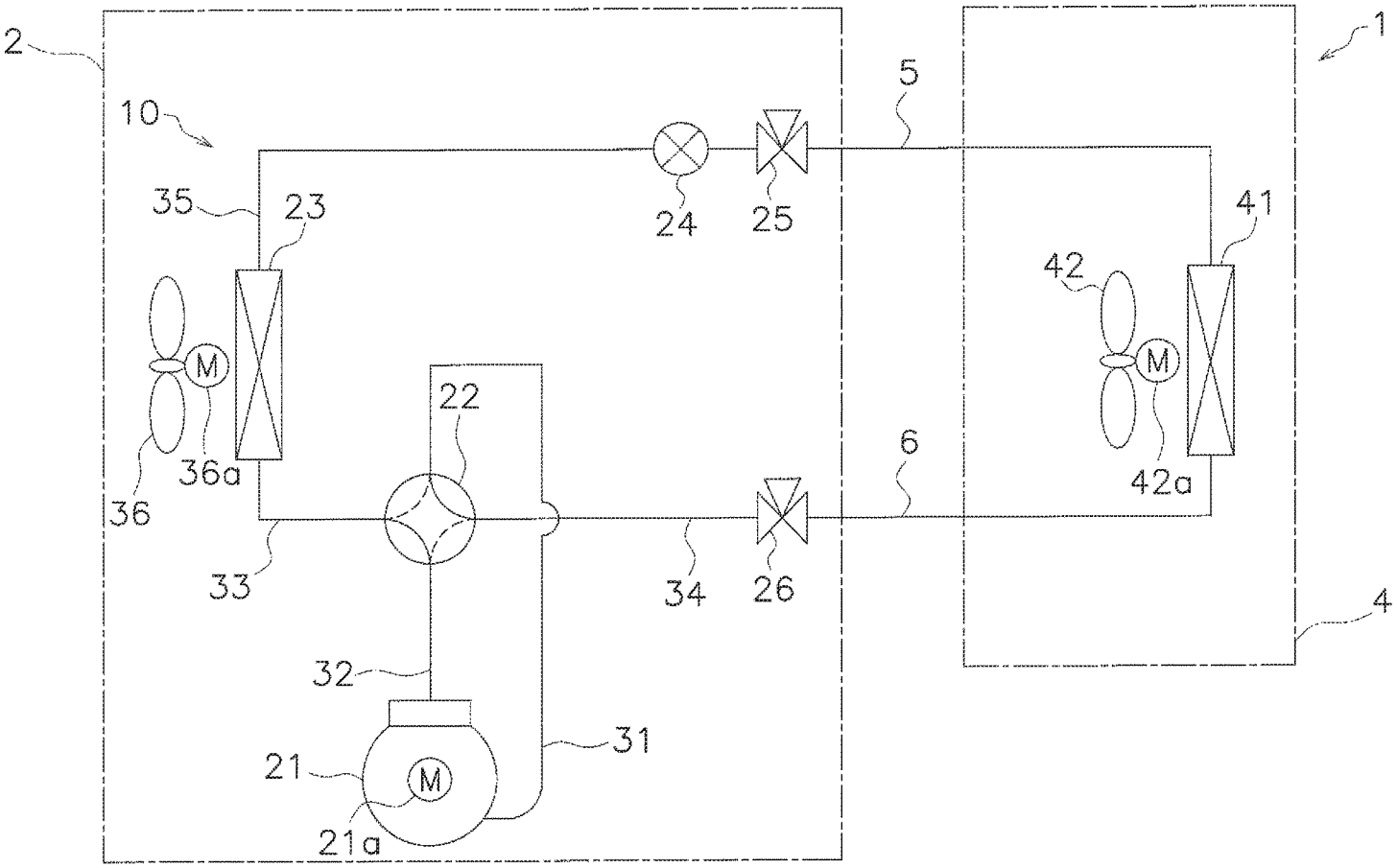
FIG. 1 is a schematic diagram of an air conditioning apparatus having an outdoor heat exchanger that employs a refrigerant diverter according to an embodiment of the present invention.

FIG. 1 is a schematic diagram of an air conditioning apparatus 1 having an outdoor heat exchanger 23 that employs a refrigerant diverter 70 according to an embodiment of the present invention.

The air conditioning apparatus 1 is capable of performing air-cooling and air-warming in a room of a building etc. by performing a vapor-compression refrigerating cycle.

The air conditioning apparatus 1 is mainly composed of an outdoor unit 2 and an indoor unit 4 that are connected to each other. In this configuration, the outdoor unit 2 and the indoor unit 4 are connected via a liquid refrigerant communication pipe 5 and a gas refrigerant communication pipe 6. In other words, a vapor-compression refrigerant circuit 10 of the air conditioning apparatus 1 is configured by the outdoor unit 2 and the indoor unit 4 being connected together via the refrigerant communication pipes 5, 6.

<Indoor Unit>

The indoor unit 4 is disposed indoors and constitutes a portion of the refrigerant circuit 10. The indoor unit 4 mainly has an indoor heat exchanger 41.

The indoor heat exchanger 41 functions as an evaporator for the refrigerant during air-cooling operation to cool indoor air, and functions as a radiator for the refrigerant during air-warming operation to heat indoor air. The liquid side of the indoor heat exchanger 41 is connected to the liquid refrigerant communication pipe 5, and the gas side of the indoor heat exchanger 41 is connected to the gas refrigerant communication pipe 6.

The indoor unit 4 has an indoor fan 42 for drawing indoor air into the indoor unit 4, and supplying the air as supply air into the room after the air has exchanged heat with the refrigerant in the indoor heat exchanger 41. In other words, the indoor unit 4 has the indoor fan 42 as a fan for supplying the indoor heat exchanger 41 with indoor air used as a source for heating or cooling refrigerant flowing through the indoor heat exchanger 41. In the present embodiment, a centrifugal fan, a multi-blade fan, or the like, driven by an indoor fan motor 42*a*, is used as the indoor fan 42.

<Outdoor Unit>

The outdoor unit 2 is installed outdoors and constitutes a portion of the refrigerant circuit 10. The outdoor unit 2 mainly has a compressor 21, a four-way switching valve 22, an outdoor heat exchanger 23, an expansion valve 24, a liquid-side shutoff valve 25, and a gas-side shutoff valve 26.

The compressor 21 is a device for compressing the low-pressure refrigerant in the refrigerating cycle to a high pressure. The compressor 21 is an airtight structure for rotatably driving a rotary-type, scroll-type, or other positive-displacement compression element (not shown) with the aid of the compressor motor 21*a*. The compressor 21 has an intake pipe 31 connected to the intake side and a discharge pipe 32 connected to the discharge side. The intake pipe 31 is a refrigerant pipe for connecting the intake side of the compressor 21 and the four-way switching valve 22. The discharge pipe 32 is a refrigerant pipe for connecting the discharge side of the compressor 21 and the four-way switching valve 22.

The four-way switching valve 22 switches the direction of the flow of refrigerant in the refrigerant circuit 10. During air-cooling operation, the four-way switching valve 22 switches to an air-cooling cycle state for causing the outdoor heat exchanger 23 to function as a radiator of the refrigerant compressed in the compressor 21, and for causing the indoor heat exchanger 41 to function as an evaporator of the refrigerant which has radiated heat in the outdoor heat exchanger 23. In other words, during air-cooling operation, the four-way switching valve 22 connects the discharge side (in this case, the discharge pipe 32) of the compressor 21 and the gas side (in this case, a first gas refrigerant pipe 33) of the outdoor heat exchanger 23 (see the solid line of the four-way switching valve 22 in FIG. 1). Also, the intake side (in this case, the intake pipe 31) of the compressor 21 and the gas refrigerant communication pipe 6 side (in this case, a second gas refrigerant pipe 34) are connected together (see the solid line of the four-way switching valve 22 in FIG. 1). During air-warming operation, the four-way switching valve 22 switches to an air-warming cycle state for causing the outdoor heat exchanger 23 to function as an evaporator of the refrigerant which has radiated heat in the indoor heat exchanger 41, and for causing the indoor heat exchanger 41 to function as a radiator of the refrigerant compressed in the compressor 21. In other words, during air-warming operation, the four-way switching valve 22 connects the discharge side (in this case, the discharge pipe 32) of the compressor 21 and the gas refrigerant communication pipe 6 side (in this case, a second gas refrigerant pipe 34) (see the broken line of the four-way switching valve 22 in FIG. 1). Also, the intake side (in this case, the intake pipe 31) of the compressor 21 and the gas side (in this case, the first gas refrigerant pipe 33) of the outdoor heat exchanger 23 are connected together (see the broken line of the four-way switching valve 22 in FIG. 1). In this case, the first gas refrigerant pipe 33 connects the four-way switching valve 22 and the gas side of the outdoor heat exchanger 23. The second gas refrigerant pipe 34 connects the four-way switching valve 22 and the gas-side shutoff valve 26.

The outdoor heat exchanger 23 functions during air-cooling operation as a radiator of refrigerant (a refrigerant radiator) for which outdoor air is a cooling source, and functions during air-warming operation as an evaporator of refrigerant (a refrigerant evaporator) for which outdoor air is a heating source. The liquid side of the outdoor heat exchanger 23 is connected to a liquid refrigerant pipe 35, and the gas side is connected to the first gas refrigerant pipe 33. The liquid refrigerant pipe 35 is a refrigerant pipe connecting the liquid side of the outdoor heat exchanger 23 and the liquid refrigerant communication pipe 5 side.

During air-cooling operation, the expansion valve 24 decompresses high-pressure refrigerant in the refrigerating cycle which has radiated heat in the outdoor heat exchanger 23 to the low pressure of the refrigerating cycle. During air-warming operation, the expansion valve 24 decompresses high-pressure refrigerant in the refrigerating cycle which has radiated heat in the indoor heat exchanger 41 to the low pressure of the refrigerating cycle. The expansion valve 24 is provided to a portion of the liquid refrigerant pipe 35 nearer to a liquid-side shutoff valve 25. In this case, an electric expansion valve is used as the expansion valve 24.

The liquid-side shutoff valve 25 and the gas-side shutoff valve 26 are provided to the connection ports of the exterior devices and pipes (specifically, the liquid refrigerant communication pipe 5 and the gas refrigerant communication pipe 6). The liquid-side shutoff valve 25 is provided to an end section of the liquid refrigerant pipe 35. The gas-side shutoff valve 26 is provided to an end section of the second gas refrigerant pipe 34.

The outdoor unit 2 has an outdoor fan 36 for drawing outdoor air into the outdoor unit 2, and discharging the air outside after the air has exchanged heat with the refrigerant in the outdoor heat exchanger 23. In other words, the outdoor unit 2 has an outdoor fan 36 as a fan that supplies the outdoor heat exchanger 23 with outdoor air used as a source for cooling or heating the refrigerant flowing through the outdoor heat exchanger 23. In this case, a propeller fan or the like driven by an outdoor fan motor 36*a* is used as the outdoor fan 36.

<Refrigerant Communication Pipes>

The refrigerant communication pipes 5, 6 are refrigerant pipes that are constructed on site when the air conditioning apparatus 1 is installed in a building or another location of installation, and these pipes may have various lengths and/or diameters depending on the location of installation, the combination of the outdoor unit 2 and the indoor unit 4, and/or other installation conditions.

(2) Basic Actions of the Air Conditioning Apparatus

Next, the basic actions of the air conditioning apparatus 1 are described using FIG. 1. The air conditioning apparatus 1 is capable of performing air-cooling operation and air-warming operation as the basic actions.

<Air-Cooling Operation>

During air-cooling operation, the four-way switching valve 22 is switched to an air-cooling cycle state (the state shown by the solid lines in FIG. 1).

In the refrigerant circuit 10, gas refrigerant at the low pressure of the refrigerating cycle is drawn into the compressor 21, compressed to the high pressure of the refrigerating cycle, and then discharged.

The high-pressure gas refrigerant discharged from the compressor 21 is sent through the four-way switching valve 22 to the outdoor heat exchanger 23.

In the outdoor heat exchanger 23 functioning as a refrigerant radiator, the high-pressure gas refrigerant sent to the outdoor heat exchanger 23 exchanges heat with the outdoor air supplied as a cooling source by the outdoor fan 36, and radiates heat to become high-pressure liquid refrigerant.

The high-pressure liquid refrigerant that has radiated heat in the outdoor heat exchanger 23 is sent to the expansion valve 24.

The high-pressure liquid refrigerant sent to the expansion valve 24 is decompressed to the low pressure of the refrigerating cycle by the expansion valve 24, becoming low-pressure gas-liquid two-phase refrigerant. The low-pressure gas-liquid two-phase refrigerant decompressed in the expansion valve 24 is sent through the liquid-side shutoff valve 25 and the liquid refrigerant communication pipe 5 to the indoor heat exchanger 41.

The low-pressure gas-liquid two-phase refrigerant sent to the indoor heat exchanger 41 exchanges heat in the indoor heat exchanger 41 with the indoor air supplied as a heating source by the indoor fan 42, and the refrigerant evaporates. The indoor air is thereby cooled and then supplied into the room, whereby air-cooling of the room interior is performed.

The low-pressure gas refrigerant evaporated in the indoor heat exchanger 41 is drawn back into the compressor 21 through the gas refrigerant communication pipe 6, the gas-side shutoff valve 26, and the four-way switching valve 22.

<Air-Warming Operation>

During air-warming operation, the four-way switching valve 22 is switched to an air-warming cycle state (the state shown by the broken lines in FIG. 1).

In the refrigerant circuit 10, gas refrigerant at the low pressure of the refrigerating cycle is drawn into the compressor 21, compressed to the high pressure of the refrigerating cycle, and then discharged.

The high-pressure gas refrigerant discharged from the compressor 21 is sent through the four-way switching valve 22, the gas-side shutoff valve 26, and the gas refrigerant communication pipe 6, to the indoor heat exchanger 41.

The high-pressure gas refrigerant sent to the indoor heat exchanger 41 exchanges heat in the indoor heat exchanger 41 with the indoor air supplied as a cooling source by the indoor fan 42, and radiates heat to become high-pressure liquid refrigerant. The indoor air is thereby heated and then supplied into the room, whereby air-warming of the room interior is performed.

The high-pressure liquid refrigerant that has radiated heat in the indoor heat exchanger 41 is sent through the liquid refrigerant communication pipe 5 and the liquid-side shutoff valve 25 to the expansion valve 24.

The high-pressure liquid refrigerant sent to the expansion valve 24 is decompressed to the low pressure of the refrigerating cycle by the expansion valve 24, becoming low-pressure gas-liquid two-phase refrigerant. The low-pressure gas-liquid two-phase refrigerant decompressed in the expansion valve 24 is sent to the outdoor heat exchanger 23.

The low-pressure gas-liquid two-phase refrigerant sent to the outdoor heat exchanger 23 exchanges heat in the outdoor heat exchanger 23 functioning as a refrigerant evaporator with the outdoor air supplied as a heating source by the outdoor fan 36, and the refrigerant evaporates to become low-pressure gas refrigerant.

The low-pressure refrigerant evaporated in the outdoor heat exchanger 23 is drawn back into the compressor 21 through the four-way switching valve 22.

(3) Basic Configuration of the Outdoor Unit

Figure 2:
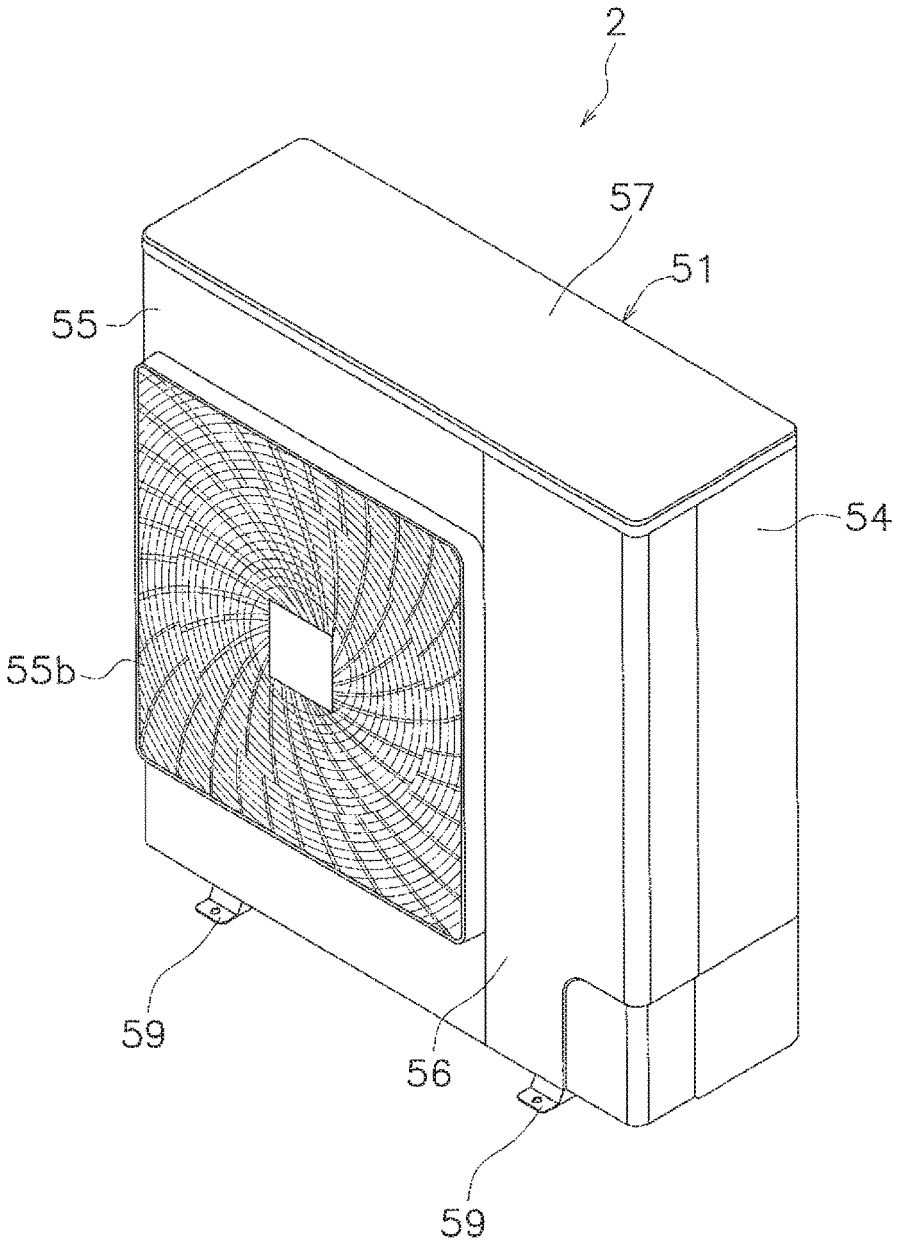
FIG. 2 is a perspective view showing an external view of an outdoor unit.
Figure 3:
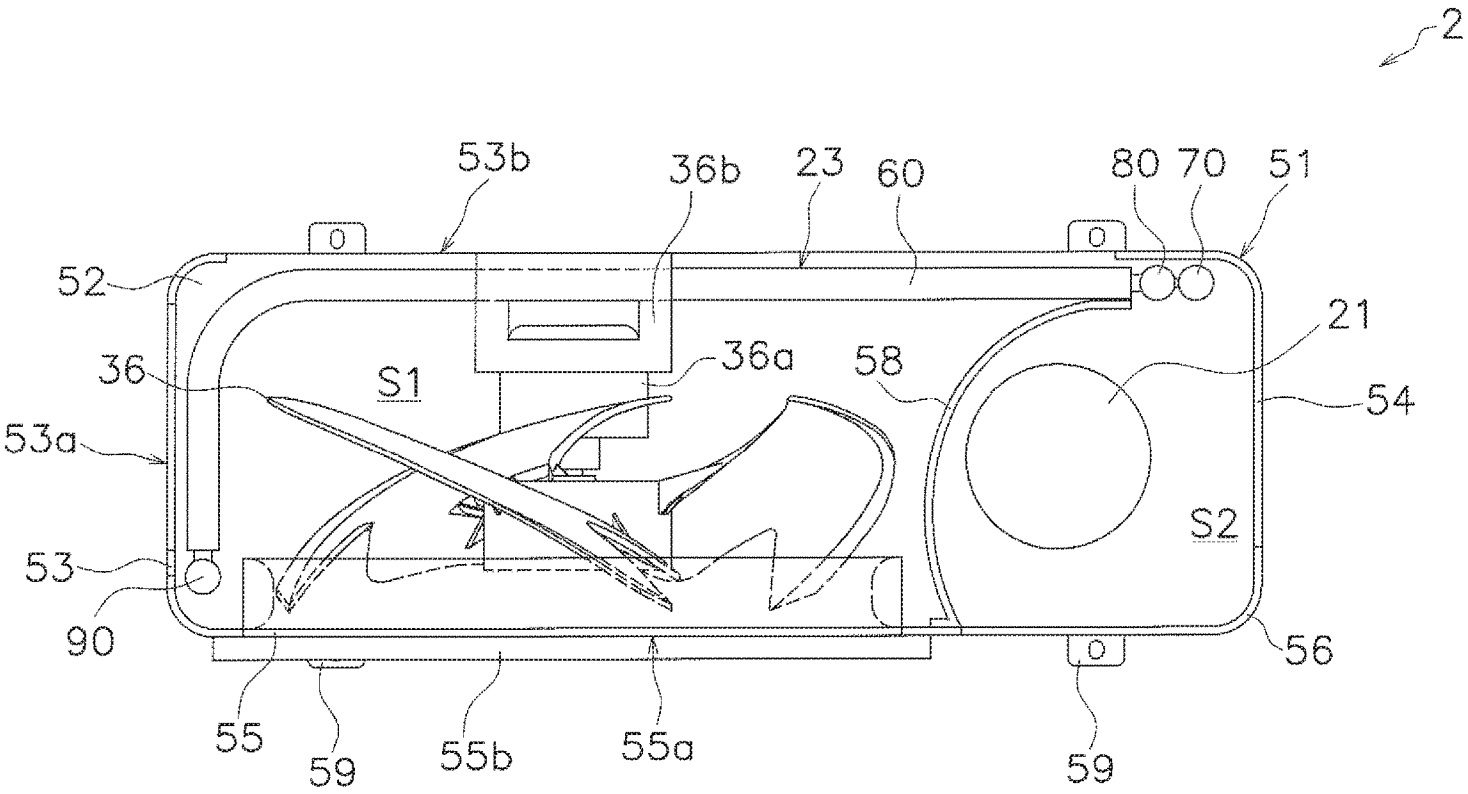
FIG. 3 is a plan view showing the outdoor unit with a top plate removed.
Figure 4:
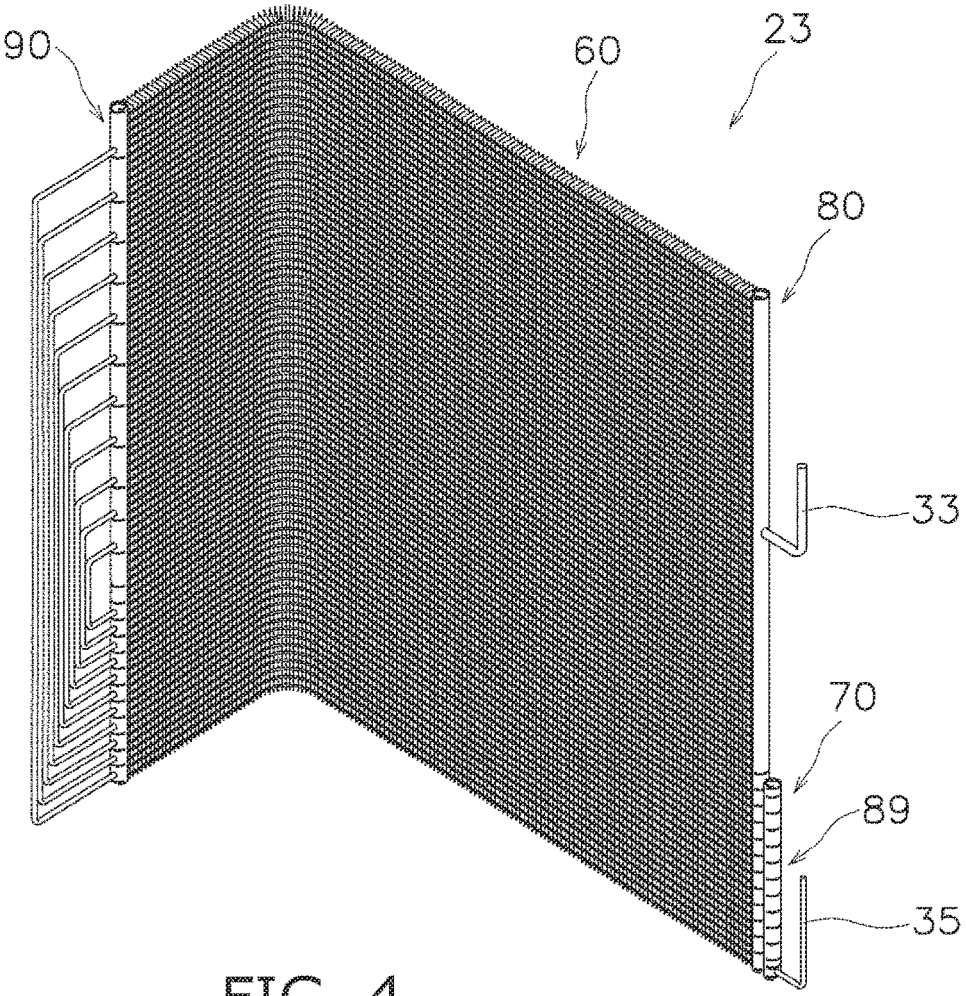
FIG. 4 is a schematic perspective view of an outdoor heat exchanger.

Next, the basic configuration of the outdoor unit 2 is described using FIGS. 1 to 4. In this case, FIG. 2 is a perspective view showing an external view of the outdoor unit 2. FIG. 3 is a plan view showing the outdoor unit 2 with a top plate 57 removed. FIG. 4 is a schematic perspective view of the outdoor heat exchanger 23. In the following description, "up," "down," "left," "right," "vertical," "front surface," "side surface," "back surface," "top surface," "bottom surface," and other terms refer to directions and surfaces in a case of the surface on a fan blow-out grill 55*b* side being the front surface, unless otherwise specified.

The outdoor unit 2 has a structure ("trunk" structure) in which the interior of a unit casing 51 is partitioned by a vertically extending partition plate 58 into an air blower compartment S1 and a machine compartment S2. The outdoor unit 2 is configured so as to take outdoor air into the interior from a portion of the back surface and a portion of the side surface of the unit casing 51, and then expel the air from the front surface of the unit casing 51. The outdoor unit 2 mainly has: the unit casing 51; the devices and pipes constituting the refrigerant circuit 10, including the compressor 21, the four-way switching valve 22, the outdoor heat exchanger 23, the expansion valve 24, the shutoff valves 25, 26, and the refrigerant pipes 31 to 35 connecting these devices; as well as the outdoor fan 36 and outdoor fan motor 36*a*. In this case, an example is described in which the air blower compartment S1 is formed near the left-side surface of the unit casing 51 and the machine compartment S2 is formed near the right-side surface of the unit casing 51, but this left-right arrangement may be reversed.

The unit casing 51, which is formed into a substantially rectangular parallelepiped shape, mainly houses the devices and pipes configuring the refrigerant circuit 10, including the compressor 21, the four-way switching valve 22, the outdoor heat exchanger 23, the expansion valve 24, the shutoff valves 25, 26, and the refrigerant pipes 31 to 35 connecting these devices; as well as the outdoor fan 36 and outdoor fan motor 36*a*. The unit casing 51 has: a bottom frame 52 on which the devices and pipes 21 to 26 and 31 to 35 configuring the refrigerant circuit 10, the outdoor fan 36, and other components are placed, an air blower compartment-side side plate 53; a machine compartment-side side plate 54; an air blower compartment-side front plate 55; a machine compartment-side front plate 56; a top plate 57; and two mounting legs 59.

The bottom frame 52 is a plate-shaped member configuring the bottom surface portion of the unit casing 51.

The air blower compartment-side side plate 53 is a plate-shaped member configuring the side surface portion (in this case, the left-side surface portion) of the unit casing 51 that is near the air blower compartment S1. The lower part of the air blower compartment-side side plate 53 is fixed to the bottom frame 52. Formed in the air blower compartment-side side plate 53 is a side surface fan intake port 53*a* for outdoor air to be drawn by the outdoor fan 36 into the unit casing 51 from the side-surface side of the unit casing 51.

The machine compartment-side side plate 54 is a plate-shaped member configuring part of the side surface portion (in this case, the right-side surface portion) of the unit casing 51 that is near the machine compartment S2, and the back surface portion of the unit casing 51 that is near the machine compartment S2. The lower part of the machine compartment-side side plate 54 is fixed to the bottom frame 52. Between the end section of the air blower compartment-side side plate 53 on the back surface side and the end section of the machine compartment-side side plate 54 on the air blower compartment S1 side is formed a back surface fan intake port 53*b* for outdoor air to be drawn by the outdoor fan 36 into the unit casing 51 from the back surface side of the unit casing 51.

The air blower compartment-side front plate 55 is a plate-shaped member configuring the front surface portion of the air blower compartment S1 of the unit casing 51. The lower part of the air blower compartment-side front plate 55 is fixed to the bottom frame 52, and the end section on the side of the left-side surface is fixed to the end section of the air blower compartment-side side plate 53 on the front surface side. The air blower compartment-side front plate 55 is provided with a fan blow-out port 55*a* for blowing to the outside the outdoor air drawn into the unit casing 51 by the outdoor fan 36. The front surface side of the air blower compartment-side front plate 55 is provided with a fan blow-out grill 55*b* that covers the fan blow-out port 55*a*.

The machine compartment-side front plate 56 is a plate-shaped member configuring a part of the front surface portion of the machine compartment S2 of the unit casing 51, and a part of the side surface portion of the machine compartment S2 of the unit casing 51. The end section of the machine compartment-side front plate 56 on the air blower compartment S1 side is fixed to the end section of the air blower compartment-side front plate 55 on the machine compartment S2 side, and the end section of the machine compartment-side front plate 56 on the back surface side is fixed to the end section of the machine compartment-side side plate 54 on the front surface side.

The top plate 57 is a plate-shaped member configuring the top surface portion of the unit casing 51. The top plate 57 is fixed to the air blower compartment-side side plate 53, the machine compartment-side side plate 54, and the air blower compartment-side front plate 55.

The partition plate 58 is a vertically extending plate-shaped member disposed on the bottom frame 52. The partition plate 58 in this case divides the interior of the unit casing 51 into left and right spaces, thereby forming the air blower compartment S1, which is near the left side surface, and the machine compartment S2, which is near the right side surface. The lower part of the partition plate 58 is fixed to the bottom frame 52, the end section on the front surface side is fixed to the air blower compartment-side front plate 55, and the end section on the back surface side extends to the side end section of the outdoor heat exchanger 23 that is near the machine compartment S2.

The mounting legs 59 are plate-shaped members extending in the front-back direction of the unit casing 51. The mounting legs 59 are members fixed to a mounting surface of the outdoor unit 2. In this embodiment, the outdoor unit 2 has two mounting legs 59, one being disposed near the air blower compartment S1, and the other being disposed near the machine compartment S2.

The outdoor fan 36 is a propeller fan having a plurality of blades, and is disposed at a position on the front surface side of the outdoor heat exchanger 23 within the air blower compartment S1 so as to face the front surface (in this case, the fan blow-out port 55*a*) of the unit casing 51. The outdoor fan motor 36*a* is disposed anteroposteriorly between the outdoor fan 36 and the outdoor heat exchanger 23 within the air blower compartment S1. The outdoor fan motor 36*a* is supported by a motor support stand 36*b* placed on the bottom frame 52. The outdoor fan 36 is axially supported on the outdoor fan motor 36*a*.

The outdoor heat exchanger 23 is a heat exchanger panel substantially in the shape of the letter L as seen in a plan view, and is placed on the bottom frame 52 so as to face the side surface (in this case, the left side surface) and the back surface of the unit casing 51 within the air blower compartment S1.

The compressor 21 in this case is a hermetic compressor in the shape of a vertical cylinder, and is placed on the bottom frame 52 within the machine compartment S2.

(4) Basic Configuration of the Outdoor Heat Exchanger

Figure 5:
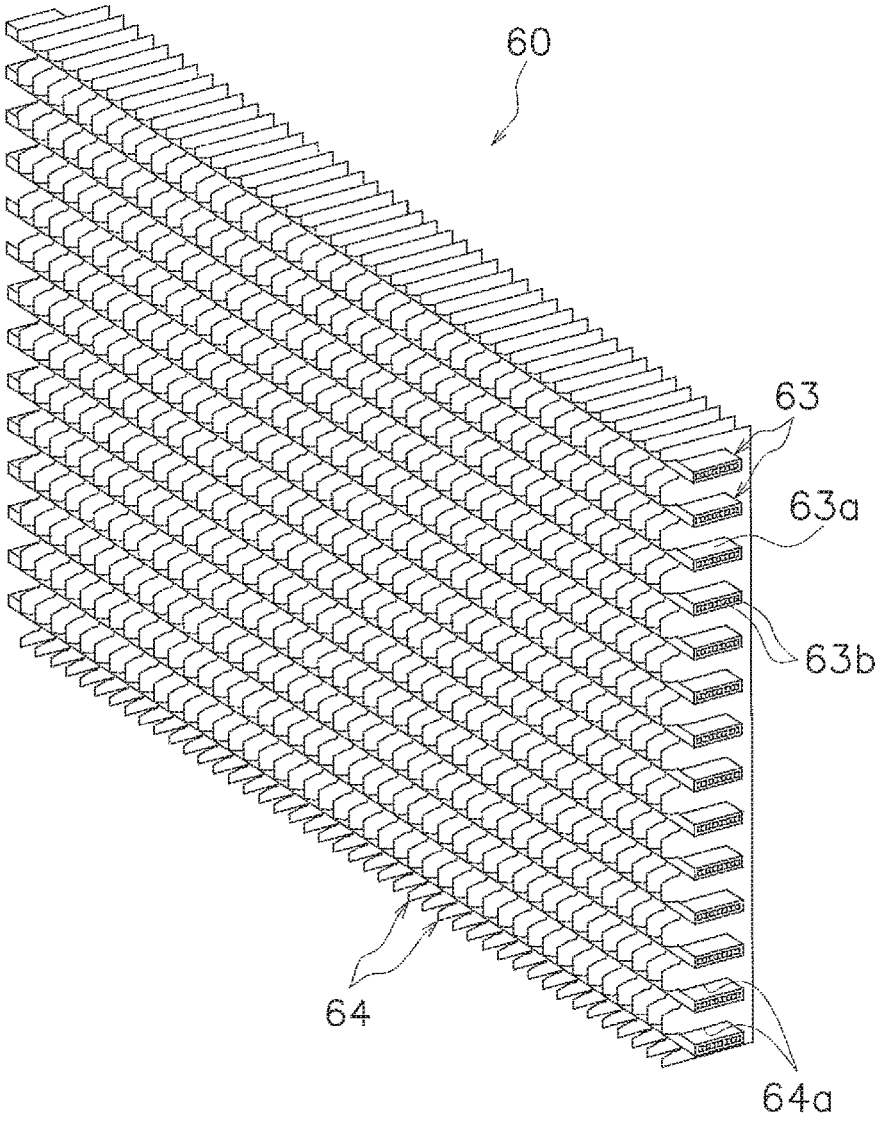
FIG. 5 is a partial enlarged view of a heat exchange section in FIG. 4.
Figure 6:
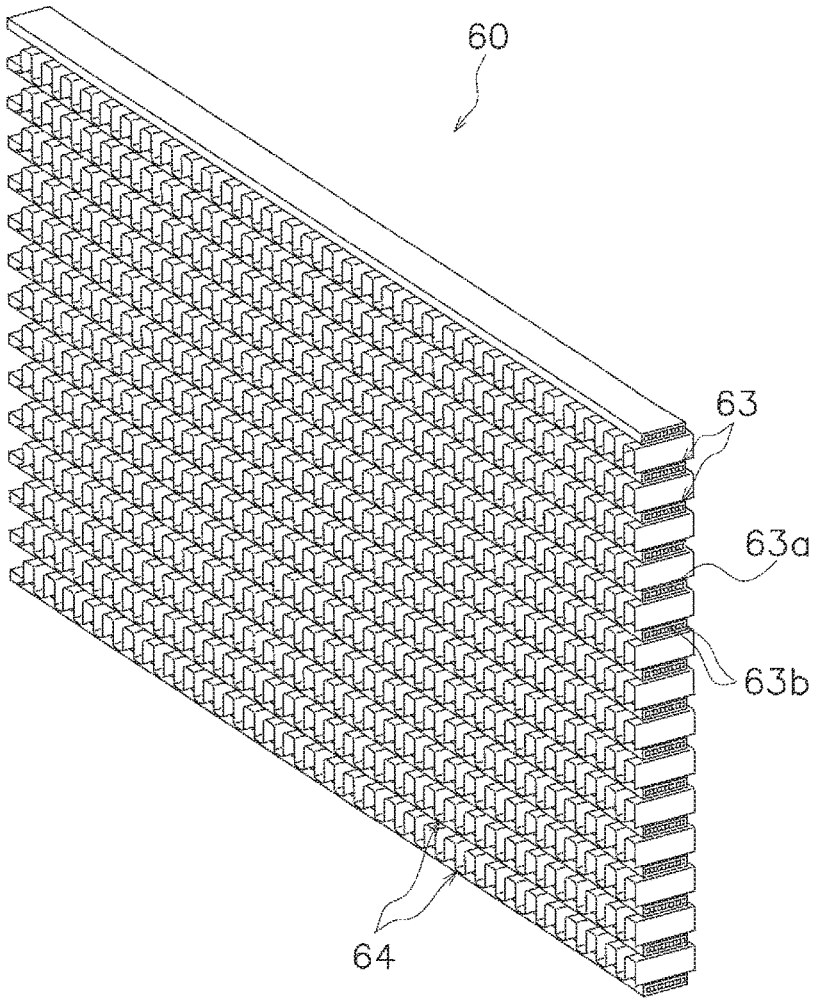
FIG. 6 is a drawing, corresponding to FIG. 5, of a case in which corrugated fins are employed as heat transfer fins.
Figure 7:
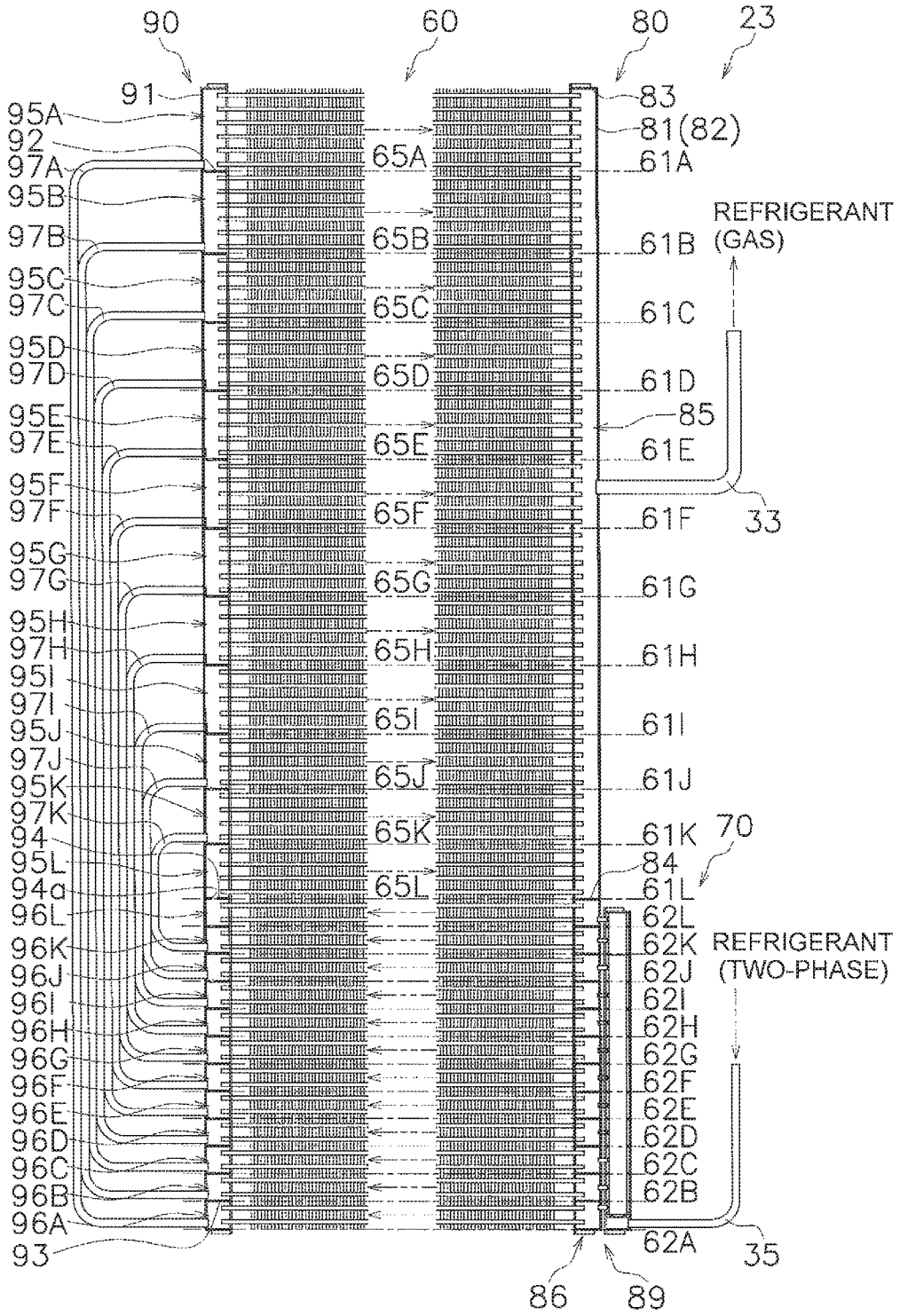
FIG. 7 is a schematic diagram of the outdoor heat exchanger.

Next, the configuration of the outdoor heat exchanger 23 is described using FIGS. 1 to 7. In this case, FIG. 5 is a partial enlarged view of a heat exchange section 60 in FIG. 4. FIG. 6 is a drawing, corresponding to FIG. 5, of a case in which corrugated fins are employed as heat transfer fins 64. FIG. 7 is a schematic diagram of the outdoor heat exchanger 23. In the following description, terms representing directions and surfaces refer to directions and surfaces based on the outdoor heat exchanger 23 being placed in the outdoor unit 2, unless otherwise specified.

The outdoor heat exchanger 23 mainly has the heat exchange section 60 for conducting heat exchange between the outdoor air and the refrigerant, a refrigerant diverter 70 and an entry-exit header 80 provided on one end side of the heat exchange section 60, and an intermediate header 90 provided on the other end side of the heat exchange section 60. The outdoor heat exchanger 23 is an all-aluminum heat exchanger in which the refrigerant diverter 70, the entry-exit header 80, the intermediate header 90, and the heat exchange section 60 are all formed from aluminum or an aluminum alloy, and these components are bonded by in-furnace brazing or another type of brazing.

The heat exchange section 60 has a plurality of main heat exchange sections (in this case, twelve) 61A to 61L configuring the upper part of the outdoor heat exchanger 23, and a plurality of sub heat exchange sections (in this case, twelve) 62A to 62L configuring the lower part of the outdoor heat exchanger 23. In the main heat exchange sections 61A to 61L, the main heat exchange section 61A is disposed at the highest level, and from the next level below, the main heat exchange sections 61B to 61L are disposed in sequence vertically downward. In the sub heat exchange sections 62A to 62L, the sub heat exchange section 62A is disposed at the lowest level, and from the next level above, the sub heat exchange sections 62B to 62L are disposed in sequence vertically upward.

The heat exchange section 60 is an inserted fin type heat exchanger configured from multiple heat transfer tubes 63 comprising flat tubes, and multiple heat transfer fins 64 comprising inserted fins. The heat transfer tubes 63 are flat, perforated tubes formed from aluminum or an aluminum alloy, each of which has a flat surface part 63*a* serving as a heat transfer surface and facing in the vertical direction and multiple small internal flow channels 63*b* through which refrigerant flows. The multiple heat transfer tubes 63 are disposed in a plurality of levels spaced apart along the vertical direction, and both ends of each are connected to the entry-exit header 80 and the intermediate header 90. The heat transfer fins 64 are formed from aluminum or an aluminum alloy, in which multiple notches 64*a* extending horizontally lengthwise are formed so that the fins can be inserted over the multiple heat transfer tubes 63 disposed between the entry-exit header 80 and the intermediate header 90. The shape of the notches 64*a* of the heat transfer fins 64 substantially coincides with the cross-sectional outer shape of the heat transfer tubes 63. The multiple heat transfer tubes 63 are sectioned into the main heat exchange sections 61A to 61L and the sub heat exchange sections 62A to 62L described above. In this case, the numerous heat transfer tubes 63 include heat transfer tube groups configuring the main heat exchange sections 61A to 61L in intervals of a predetermined number (approximately three to eight) of heat transfer tubes 63, along vertically downward from the highest level of the outdoor heat exchanger 23. Also included are heat transfer tube groups configuring the sub heat exchange sections 62A to 62L in intervals of a predetermined number (approximately one to three) of heat transfer tubes 63, along vertically upward from the lowest level of the outdoor heat exchanger 23.

The outdoor heat exchanger 23 is not limited to an inserted fin type heat exchanger that employs inserted fins (see FIG. 5) as the heat transfer fins 64 as described above, and may also be a corrugated fin type heat exchanger that employs multiple corrugated fins (see FIG. 6) as the heat transfer fins 64.

(5) Configuration of the Intermediate Header

Next, the configuration of the intermediate header 90 is described using FIGS. 1 to 7. In the following description, terms representing directions and surfaces refer to directions and surfaces based on the outdoor heat exchanger 23, including the intermediate header 90, being placed in the outdoor unit 2, unless otherwise specified.

The intermediate header 90 is provided to the other end side of the heat exchange section 60 as described above, and the other ends of the heat transfer tubes 63 are connected to the intermediate header 90. The intermediate header 90 is a vertically extending cylindrical member formed from aluminum or an aluminum alloy, and the intermediate header 90 mainly has an intermediate header case 91 that is vertically long and hollow.

The internal space of the intermediate header case 91 is partitioned along the vertical direction by a plurality of main-side intermediate baffles (in this case, eleven) 92, a plurality of sub-side intermediate baffles (in this case, eleven) 93, and a border-side intermediate baffle 94. The main-side intermediate baffles 92 are provided sequentially along the vertical direction so as to partition the internal space in the upper part of the intermediate header case 91 into main-side intermediate spaces 95A to 95K communicating with the other ends of main heat exchange sections 61A to 61K. The sub-side intermediate baffles 93 are provided sequentially along the vertical direction so as to partition the internal space in the lower part of the intermediate header case 91 into sub-side intermediate spaces 96A to 96K communicating with the other ends of sub heat exchange sections 62A to 62K. The border-side intermediate baffle 94 is provided so as to partition the internal space vertically between the main-side intermediate baffle 92 at the lowest level of the intermediate header case 91 and the sub-side intermediate baffle 93 at the highest level into a main-side intermediate space 95L communicating with the other end of a main heat exchange section 61L and a sub-side intermediate space 96L communicating with the other end of a sub heat exchange section 62L.

A plurality of intermediate communicating pipes (in this case, eleven) 97A to 97K are connected to the intermediate header case 91. The intermediate communicating pipes 97A to 97K are refrigerant pipes via which the main-side intermediate spaces 95A to 95K and the sub-side intermediate spaces 96A to 96K communicate. The main heat exchange sections 61A to 61K and the sub heat exchange sections 62A to 62K thereby communicate via the intermediate header 90 and the intermediate communicating pipes 97A to 97K, and refrigerant paths 65A to 65K of the outdoor heat exchanger 23 are formed. In the border-side intermediate baffle 94 is formed an intermediate baffle communication hole 94*a* which enables communication between the main-side intermediate space 95L and the sub-side intermediate space 96L. The main heat exchange section 61L and the sub heat exchange section 62L thereby communicate via the intermediate header 90 and the intermediate baffle communication hole 94*a*, and a refrigerant path 65L of the outdoor heat exchanger 23 is formed. Thus, the outdoor heat exchanger 23 has a configuration sectioned into multiple paths (in this case, twelve), which are the refrigerant paths 65A to 65L.

The intermediate header 90 is not limited to a configuration in which the internal space of the intermediate header case 91 is merely partitioned along the vertical direction by the intermediate baffles 92, 93 as described above, and may have a configuration designed in order to satisfactorily maintain the state of refrigerant flow within the intermediate header 90.

(6) Configuration of Entry-Exit Header and Refrigerant Diverter

Figure 8:
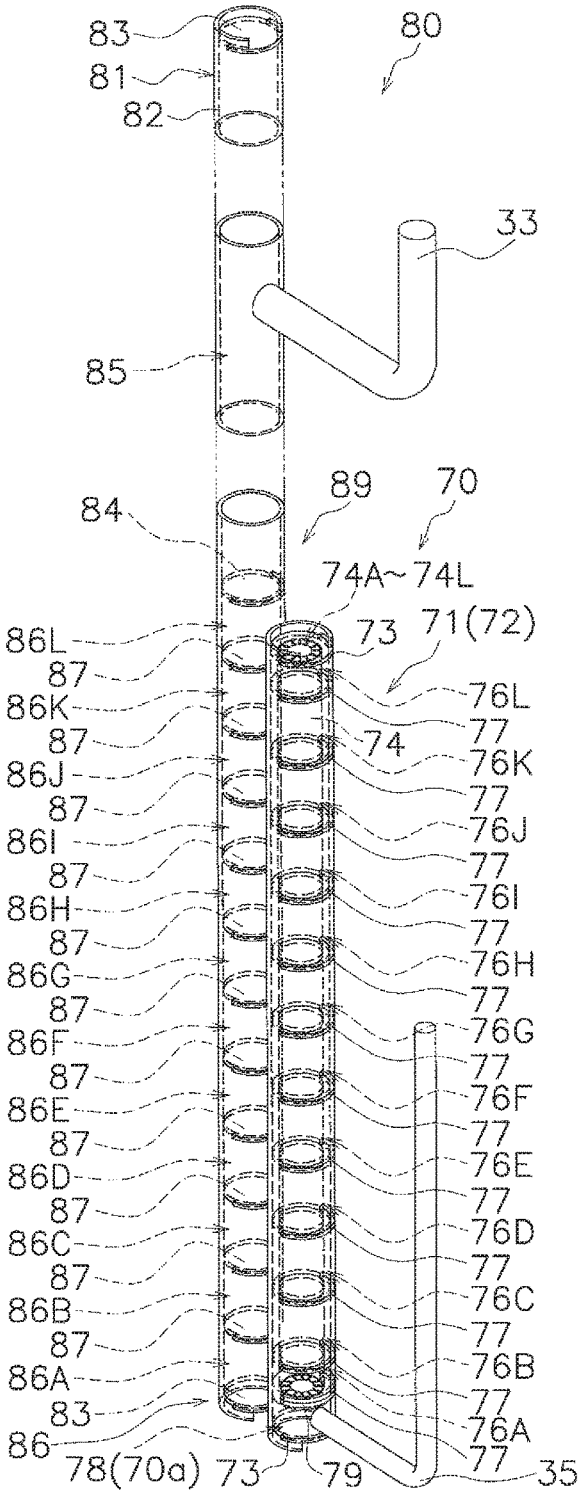
FIG. 8 is an enlarged view of an entry-exit header and the refrigerant diverter in FIG. 4.
Figure 9:
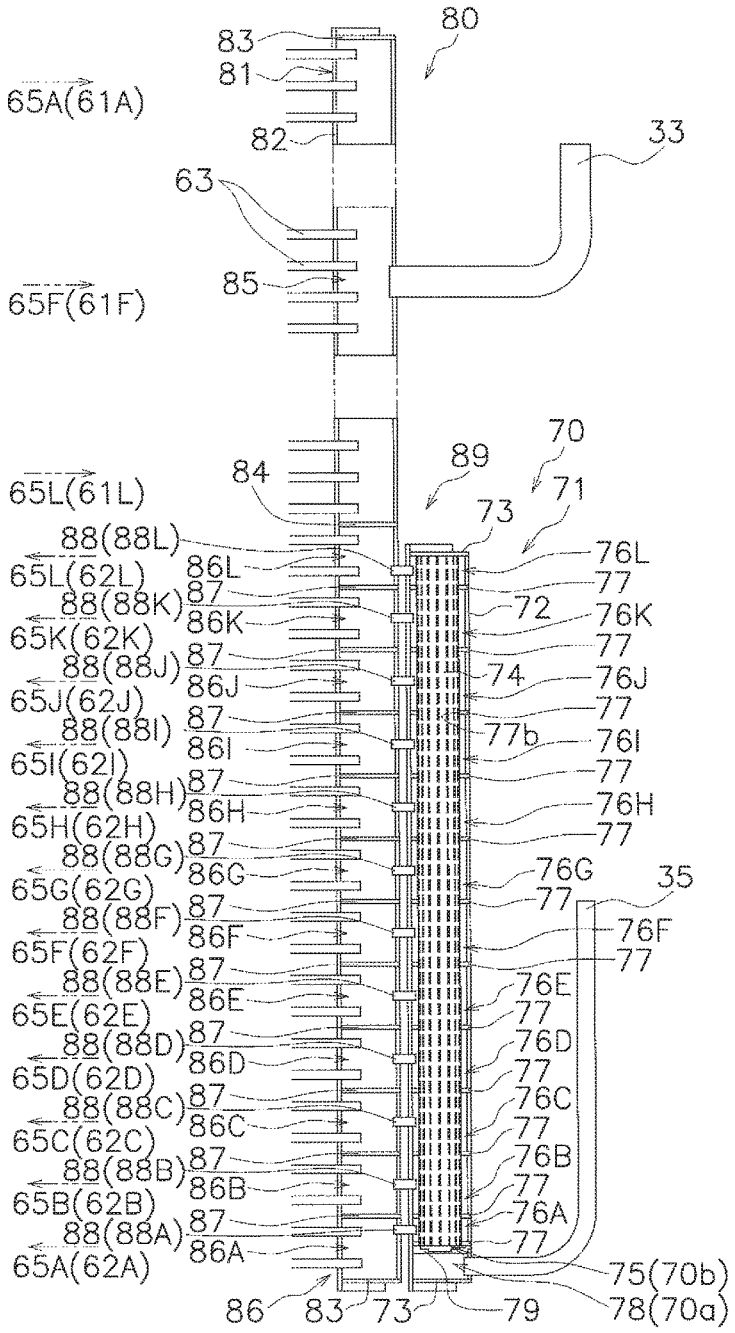
FIG. 9 is an enlarged cross-sectional view of an entry-exit header and a refrigerant diverter in FIG. 7.
Figure 10:
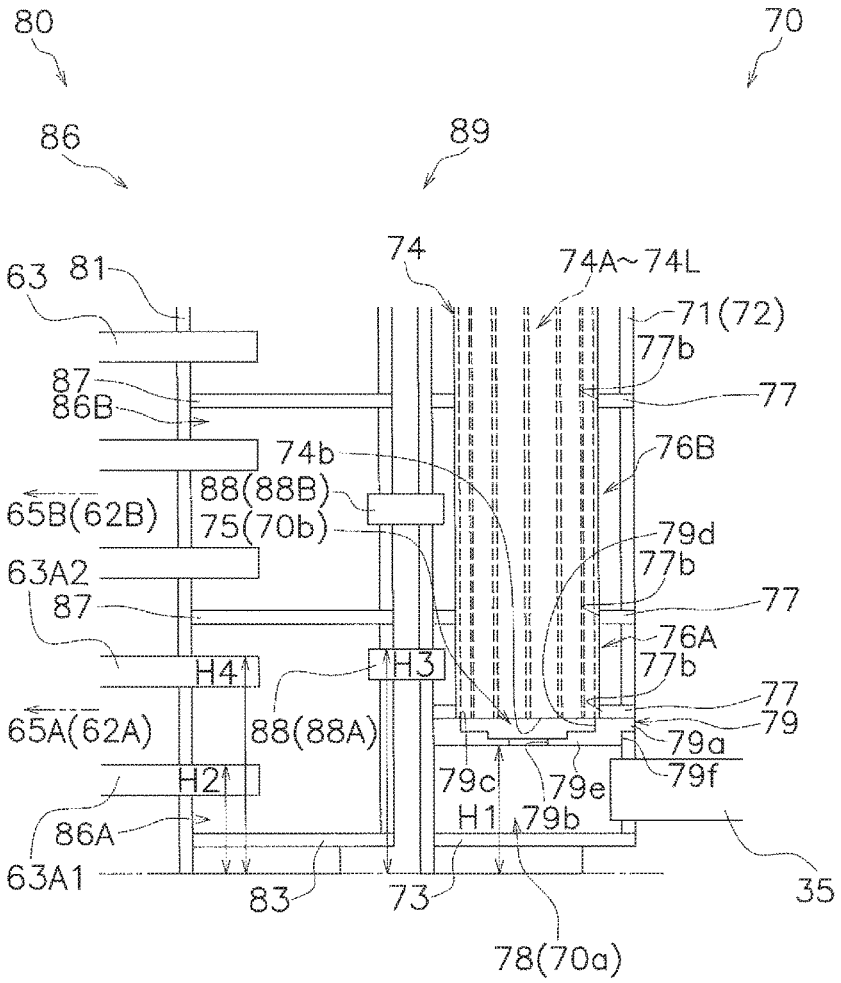
FIG. 10 is an enlarged cross-sectional view of the lower parts of the entry-exit header and the refrigerant diverter in FIG. 9.
Figure 11:
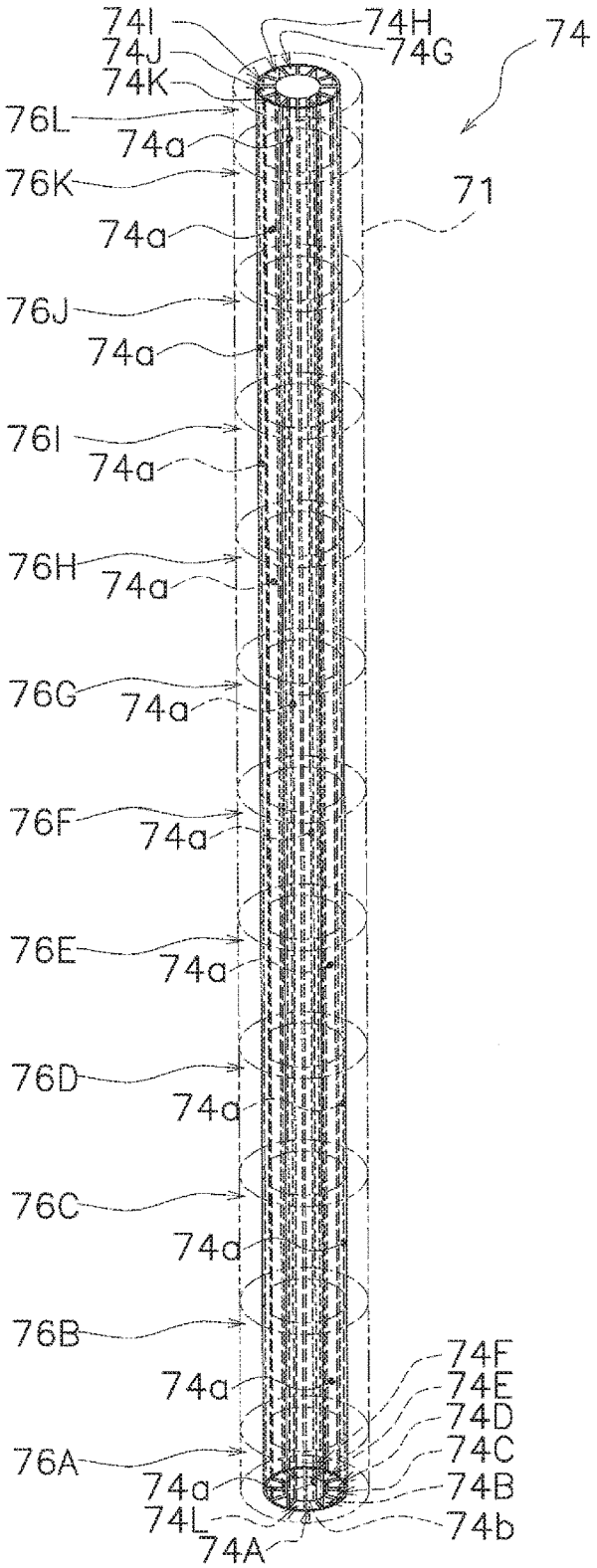
FIG. 11 is a perspective view of a rod member.
Figure 12:
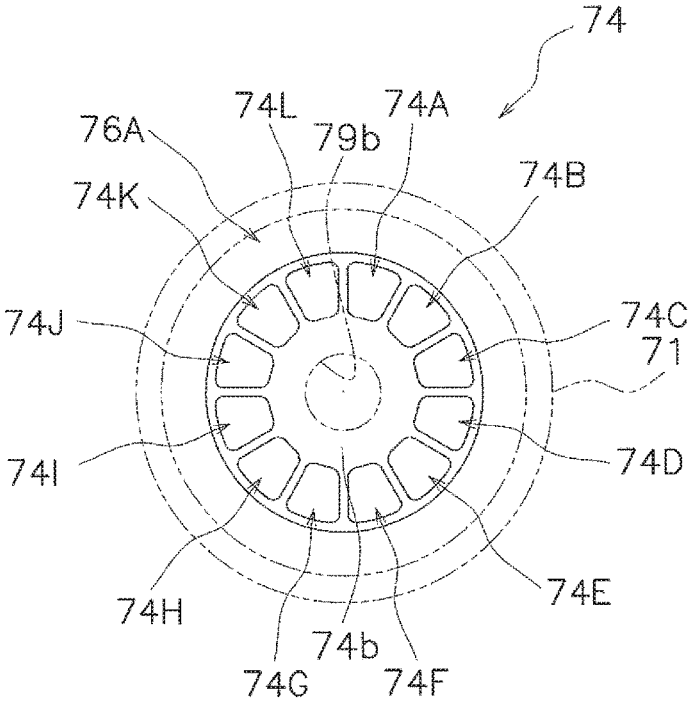
FIG. 12 is a plan view of the rod member.
Figure 13:
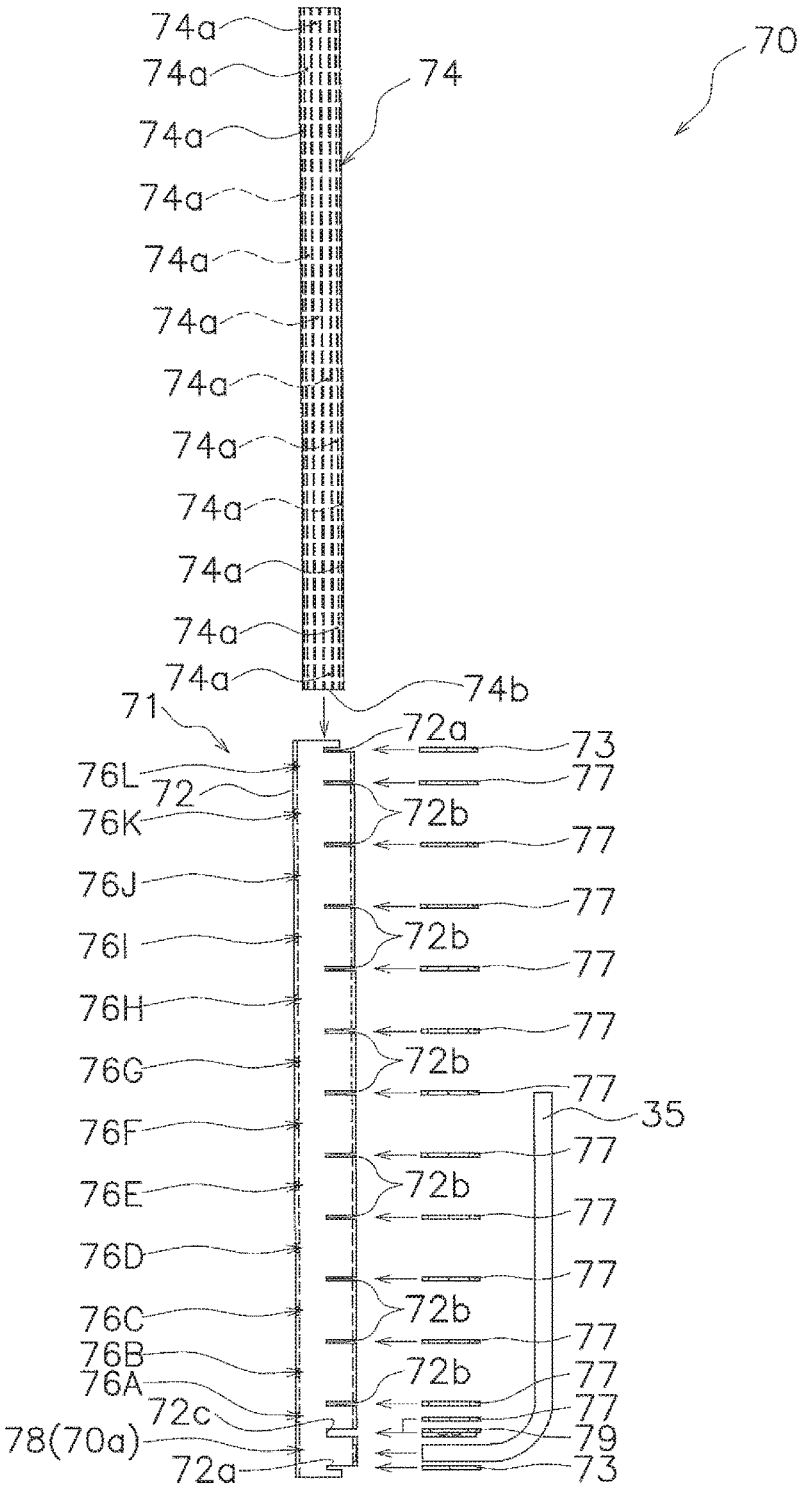
FIG. 13 is an exploded view of the refrigerant diverter.
Figure 14:
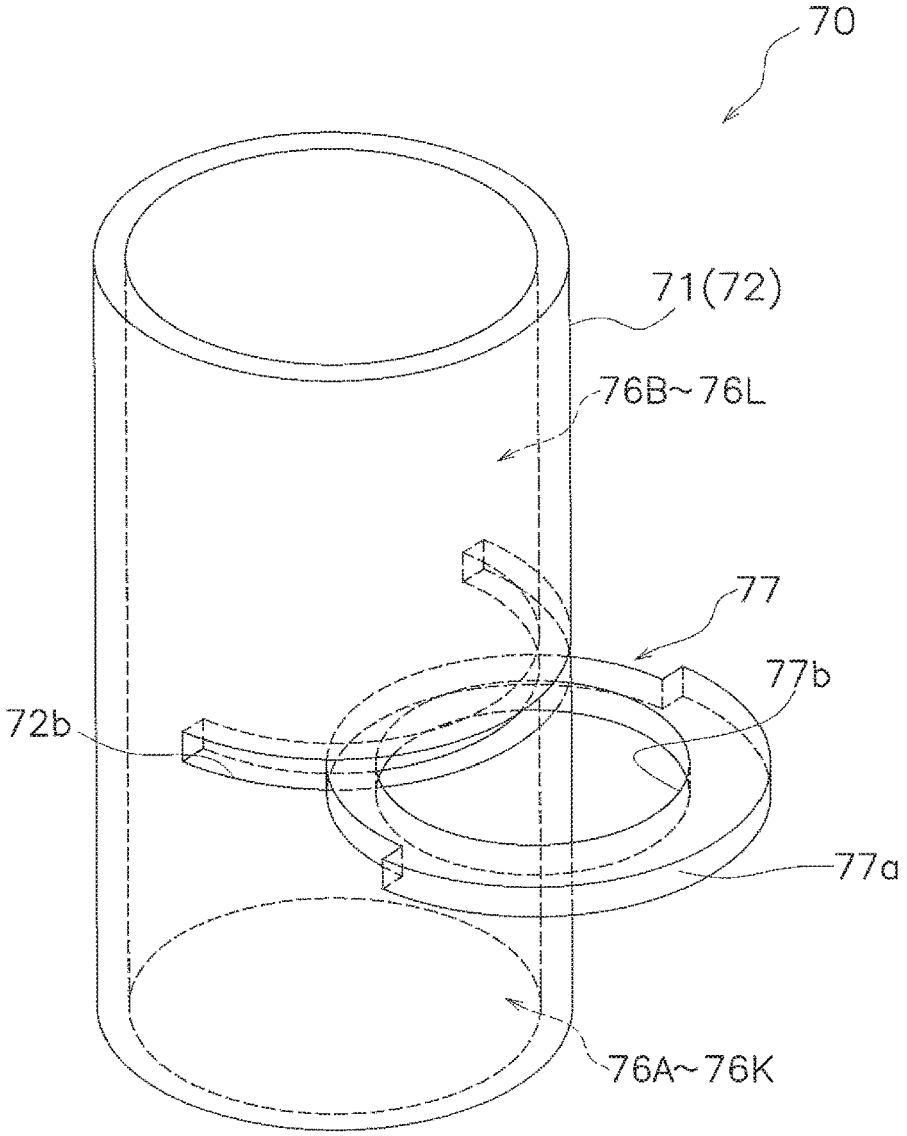
FIG. 14 is a perspective view showing the manner in which a rod-through baffle is inserted into a diverter case.
Figure 15:
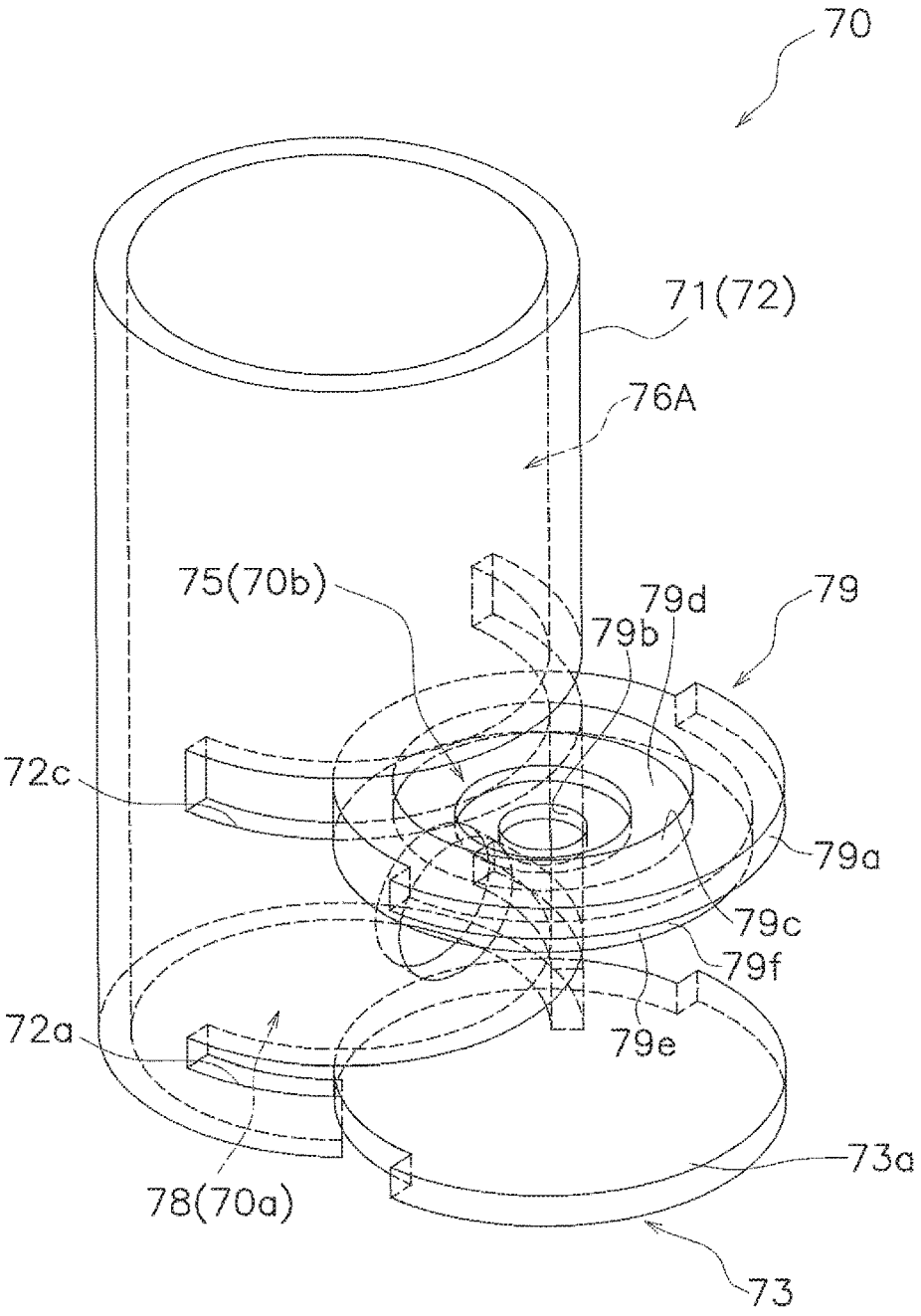
FIG. 15 is a perspective view showing the manner in which a nozzle member and an upper/lower-end-side diverter baffle are inserted into the diverter case.
Figure 16:
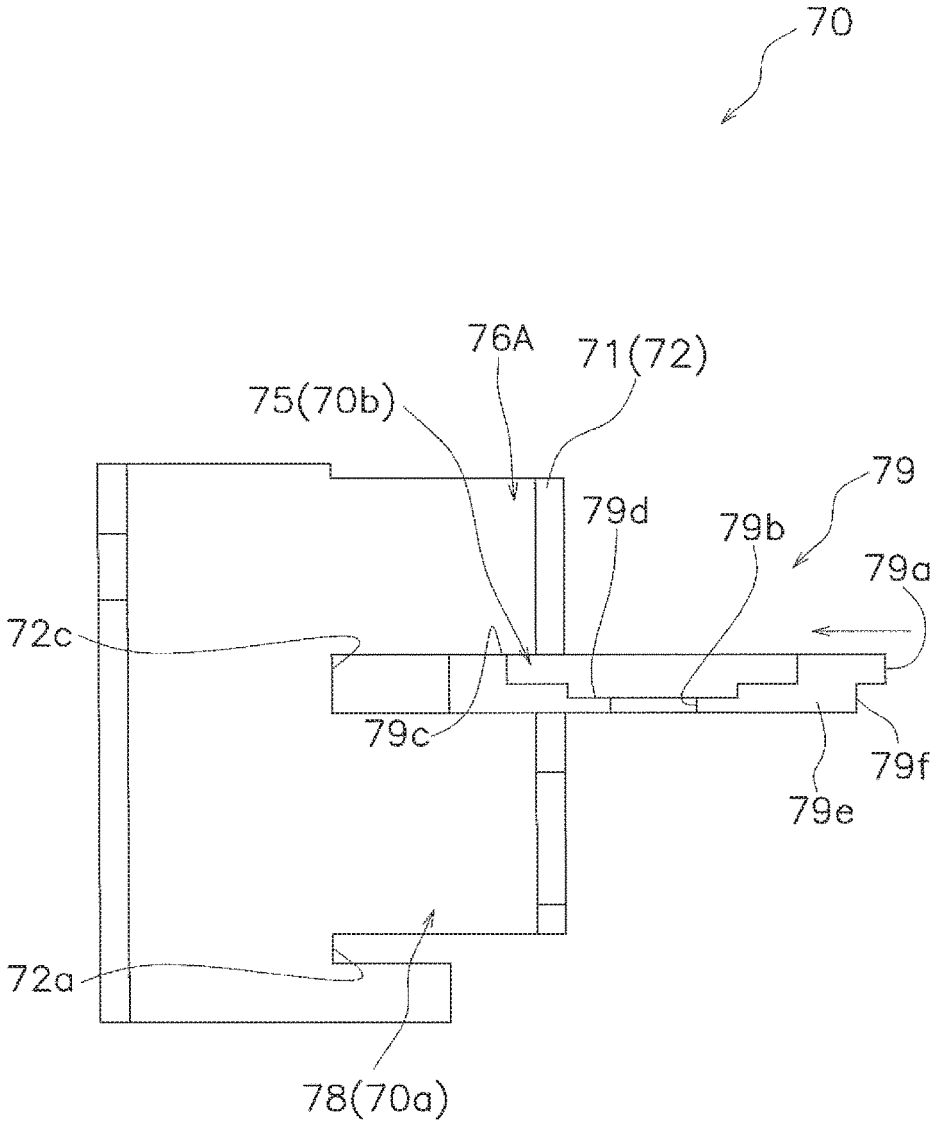
FIG. 16 is a cross-sectional view showing the manner in which the nozzle member is inserted into the diverter case.
Figure 17:
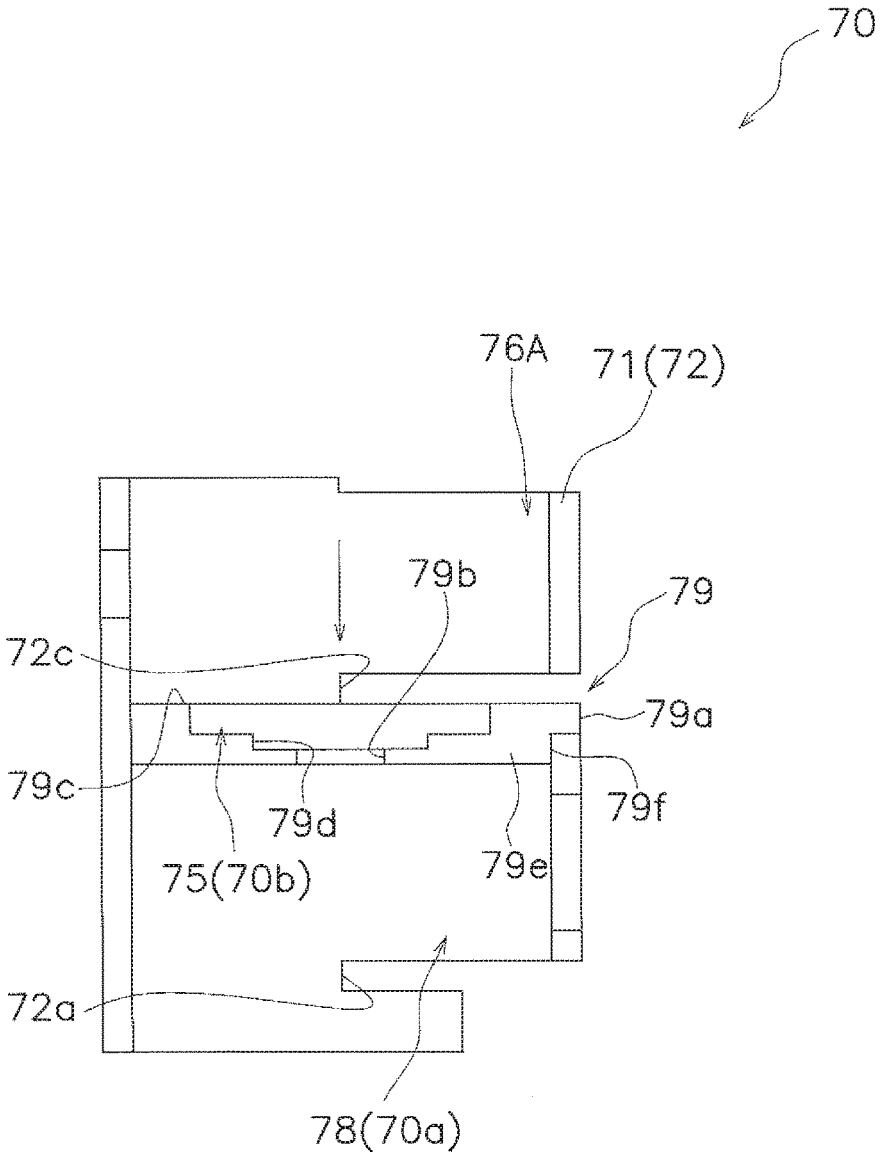
FIG. 17 is a cross-sectional view showing the manner in which the nozzle member is fitted into the diverter case.
Figure 18:
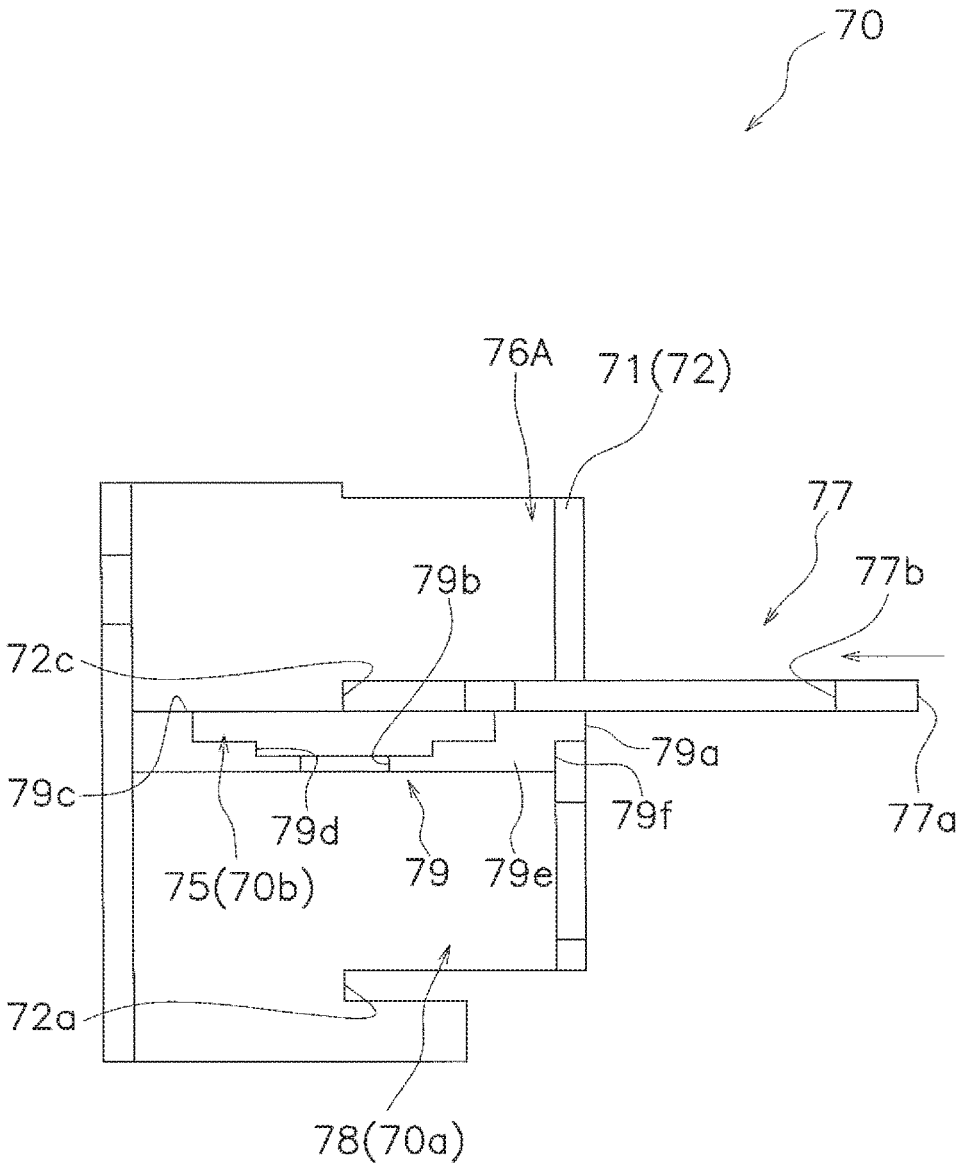
FIG. 18 is a cross-sectional view showing the manner in which a gap formed after the nozzle member is fitted into the diverter case is filled in by the rod-through baffle.

Next, the configurations of the entry-exit header 80 and the refrigerant diverter 70 are described using FIGS. 1 to 18. In this case, FIG. 8 is an enlarged view of the entry-exit header 80 and the refrigerant diverter 70 in FIG. 4. FIG. 9 is an enlarged cross-sectional view of the entry-exit header 80 and the refrigerant diverter 70 in FIG. 7. FIG. 10 is an enlarged cross-sectional view of the lower parts of the entry-exit header 80 and the refrigerant diverter 70 in FIG. 9. FIG. 11 is a perspective view of a rod member 74. FIG. 12 is a plan view of the rod member 74. FIG. 13 is an exploded view of the refrigerant diverter 70. FIG. 14 is a perspective view showing the manner in which a rod through-baffle 77 is inserted into a diverter case 71. FIG. 15 is a perspective view showing the manner in which a nozzle member 79 and an upper/lower-end-side diverter baffle 73 are inserted into the diverter case 71. FIG. 16 is a cross-sectional view showing the manner in which the nozzle member 79 is inserted into the diverter case 71. FIG. 17 is a cross-sectional view showing the manner in which the nozzle member 79 is fitted into the diverter case 71. FIG. 18 is a cross-sectional view showing the manner in which a gap formed after the nozzle member 79 is fitted into the diverter case 71 is filled in by a rod through-baffle 77. In the following description, terms representing directions and surfaces refer to directions and surfaces based on the outdoor heat exchanger 23, including the refrigerant diverter 70 and the entry-exit header 80, being placed in the outdoor unit 2, unless otherwise specified. The flow of refrigerant in the outdoor heat exchanger 23, including the refrigerant diverter 70, the entry-exit header 80, and the intermediate header 90, refers to the flow of refrigerant based on the outdoor heat exchanger 23 functioning as a refrigerant evaporator, unless otherwise specified.

<Entry-Exit Header>

The entry-exit header 80 is provided to one end side of the heat exchange section 60, and the heat transfer tubes 63 are connected at one end to the entry-exit header. The intermediate header 90 is a vertically extending member formed from aluminum or an aluminum alloy, and mainly has an entry-exit header case 81 that is vertically long and hollow. The entry-exit header case 81 mainly has an entry-exit header cylindrical body 82 in the shape of a cylinder open at the upper and lower ends, and the openings in the upper and lower ends are closed by two upper/lower-end-side entry-exit baffles 83. The internal space of the entry-exit header case 81 is partitioned along the vertical direction by a border-side entry-exit baffle 84, into an entry-exit space 85 as the upper part and supply spaces 86A to 86L as the lower part. The entry-exit space 85, which communicates with one end of each of the main heat exchange sections 61A to 61L, functions as a space that allows refrigerant passing through the refrigerant paths 65A to 65L to merge in the outlets. Thus, the upper part of the entry-exit header 80 having the entry-exit space 85 functions as a refrigerant outlet part that allows refrigerant passing through the refrigerant paths 65A to 65L to merge in the outlets. The first gas refrigerant pipe 33, which is connected to the entry-exit header 80, communicates with the entry-exit space 85. The supply spaces 86A to 86L, which are a plurality of spaces (in this case, twelve) partitioned by a plurality of supply-side entry-exit baffles (in this case, eleven) 87, communicate with one end of the sub heat exchange sections 62A to 62L, and the supply spaces 86A to 86L function as spaces that allow refrigerant to flow out to the refrigerant paths 65A to 65L. The entry-exit header case 81 is not limited to the shape of a cylinder, and may be, e.g., in the shape of a rectangular prism or another polygonal prism.

Thus, the lower part of the entry-exit header 80, which has the plurality of supply spaces 86A to 86L, functions as a refrigerant supply section 86 that is sectioned in conformity with the plurality of refrigerant paths 65A to 65L and that allow refrigerant to flow out.

<Refrigerant Diverter>

The refrigerant diverter 70, as described above, is a refrigerant passage component that diverts the flow of refrigerant flowing in through the liquid refrigerant pipe 35 and causes the refrigerant to flow out to the downstream side (in this case, the plurality of heat transfer tubes 63), and is provided to one end side of the heat exchange section 60, with one end of each of the heat transfer tubes 63 being connected via the refrigerant supply section 86 of the entry-exit header 80. The refrigerant diverter 70, which is a vertically extending member formed from aluminum or an aluminum alloy, mainly has a diverter case 71 that is vertically long and hollow. The diverter case 71 mainly has a diverter header cylindrical body 72 in the shape of a cylinder open at the upper and lower ends, and the openings in the upper and lower ends are closed by two upper/lower-end-side diverter baffles 73. The upper/lower-end-side diverter baffles 73, which are cylindrical plate members in which semicircular arc-shaped edge parts 73*a* are formed, are inserted from the side surface of the diverter case 71 into insertion slits 72*a* formed in the upper and lower ends of the diverter header cylindrical body 72, and are then bonded by brazing. The diverter case 71 is not limited to a cylindrical shape, and may be, e.g., in the shape of a rectangular prism or another polygonal prism.

Formed inside the diverter case 71 are a plurality of diverting channels (in this case, twelve) 74A to 74L disposed along the circumferential direction, a diverting space 75 for guiding refrigerant to the plurality of diverting channels 74A to 74L, and a plurality of expelling spaces (in this case, twelve) 76A to 76L, which communicate with the diverting space 75 through the plurality of diverting channels 74A to 74L and which are disposed along the vertical direction.

The plurality of diverting channels (in this case, twelve) 74A to 74L are formed by a rod member 74 disposed inside the diverter case 71. The rod member 74 is a vertically extending rod-shaped member in which the plurality of diverting channels 74A to 74L disposed along the circumferential direction are formed. The rod member 74 is manufactured by extruding aluminum or an aluminum alloy, and the plurality of diverting channels 74A to 74L are configured from a plurality of holes (in this case, twelve) extending in the longitudinal direction of the rod member 74 and integrally formed in the rod member 74. The diametrically middle portion of the rod member 74 is enclosed by the plurality of diverting channels 74A to 74L. The upper end of the rod member 74, which is the other longitudinal end, is in contact with the lower surface of the upper/lower-end-side diverter baffle 73 provided to the upper end of the diverter case 71, and the upper end of the plurality of diverting channels 74A to 74L is closed. The upper end of the rod member 74 and the lower surface of the upper/lower-end-side diverter baffle 73 need not be in contact, and a tiny gap is allowable. On the contrary, the lower end of the rod member 74, which is the one longitudinal end, extends to the lower part of the diverter case 71 but does not reach the upper surface of the upper/lower-end-side diverter baffle 73 provided to the lower end of the diverter case 71, and the lower end of the plurality of diverting channels 74A to 74L is not closed. A space that faces the lower end of the rod member 74 including the diverting space 75 is thereby formed in the diverter case 71.

The outside diameter of the rod member 74 is smaller than the inside diameter of the diverter case 71. A space is formed diametrically between the side surface of the rod member 74 and the diverter case 71, and this space forms the plurality of expelling spaces 76A to 76L. In the diverter case 71 in this case, a plurality of rod through-baffles 77 (in this case, eleven), in which rod through-holes 77*b* for the rod member 74 to pass through are formed and are inserted from the side surface of the diverter case 71, and the plurality of expelling spaces 76A to 76L are formed by the plurality of rod through-baffles 77. In this case, the rod through-baffles 77 are circular plate members, each of which have a semicircular arc-shaped edge part 77*a* formed thereon. The rod through-baffles 77 are inserted from the side surface of the diverter case 71 into insertion slits 72*b* formed along the vertical direction in the side surface of diverter header cylindrical body 72, and are joined by brazing. The rod member 74 is thereby disposed inside the diverter case 71 after having passed through the plurality of rod through-holes 77*b* of the rod through-baffles 77 along the vertical direction. Thus, in the diverter case 71, the space diametrically between the side surface of the rod member 74 and the diverter case 71 is partitioned into the plurality of expelling spaces 76A to 76L running along the vertical direction by the plurality of rod through-baffles 77.

A plurality of rod-side surface holes (in this case, twelve) 74*a* are formed in the side surface of the rod member 74, and the plurality of expelling spaces 76A to 76L and the plurality of diverting channels 74A to 74L communicate through the plurality of rod-side surface holes 74*a*. In this case, the plurality of diverting channels 74A to 74L and the plurality of expelling spaces 76A to 76L have a one-to-one correspondence with each other. The rod-side surface holes 74*a* are formed so that a diverting channel communicating with a certain expelling space does not communicate with any other expelling space, such that, e.g., the rod-side surface hole 74*a* communicating with the expelling space 76A is formed to correspond only to the diverting channel 74A, and the rod-side surface hole 74*a* communicating with the expelling space 76B corresponds only to the diverting channel 74B. Additionally, the plurality of rod-side surface holes 74*a* are disposed in a helical array along the longitudinal direction (in this case, the vertical direction) of the rod member 74.

A nozzle member 79 in which a nozzle hole 79*b* is formed is provided to the diverter case 71 so that the space facing the lower end of the rod member 74 is partitioned into an inlet space 78 for letting in the inflowing refrigerant and a diverting space 75 for guiding the refrigerant to the plurality of diverting channels 74A to 74L.

The nozzle member 79 is formed from aluminum or an aluminum alloy, and is a circular plate member in which a semicircular arc-shaped edge part 79*a* is formed. In the nozzle member 79, a nozzle recess 79*d*, which is a recessed portion larger in diameter than the nozzle hole 79*b*, is formed in a rod member side end surface 79*c* which is an end surface on one longitudinal end (in this case, the lower end) side of the rod member 74, and the diverting space 75 is configured from a space enclosed by the lower end of the rod member 74 and the nozzle recess 79*d* due to the lower end of the rod member 74 being brought into contact with the rod member side end surface 79*c*. The nozzle recess 79*d* is formed so that the diameter grows larger in increments toward the lower end of the rod member 74. In the lower end of the rod member 74 is formed a to-be-entered part 74*b* that is enclosed by the plurality of diverting channels 74A to 74L and that faces the nozzle hole 79*b*, and the area of the to-be-entered part 74*b* is greater than the opening area of the nozzle hole 79*b*. The inlet space 78, located on the lower side of the nozzle member 79, lets in the refrigerant flowing in from the lower end side surface of the diverter case 71 through the liquid refrigerant pipe 35.

The nozzle member 79, which functions as a plate-shaped, holed plate member in which the nozzle hole 79*b* is formed as a hole for refrigerant to pass through, is inserted into the diverter case 71 from the side surface of the diverter case 71. In this case, the nozzle member 79 is made to move in the longitudinal direction of the diverter case 71 (in this case, downward) after the nozzle member 79 is inserted into the diverter case 71 via an insertion slit 72*c* formed in the side surface of the diverter case 71, and is thereby fitted into the diverter case 71 so as to be unable to move sideways in relation to the diverter case 71. Specifically, a stepped part 79*e* protruding toward the bottom of the diverter case 71 is formed in a surface (in this case, the lower surface) of the nozzle member 79 located at one end along the longitudinal direction of the diverter case 71. When the nozzle member 79 is made to move toward the bottom of the diverter case 71, a side surface 79*f* of the stepped part 79*e* comes into contact with the inner surface of the diverter case 71, whereby the nozzle member is fitted into the diverter case 71 so as to be unable to move sideways in relation to the diverter case 71. Furthermore, after the nozzle member 79 has been made to move toward the bottom of the diverter case 71 (i.e., after the nozzle member 79 has been fitted into the diverter case 71), a gap is formed in the insertion slit 72*c*, but a rod through-baffle 77 is inserted into this gap in this case. In other words, in this case, the rod through-baffle 77 is made to function as a gap-filling member for filling in the gap formed in the insertion slit 72*c* after the nozzle member 79 has been made to move toward the bottom of the diverter case 71. The nozzle member 79 and the rod through-baffle 77 are brazed together. The rod through-baffle 77 inserted into this insertion slit 72*c* thereby comes to overlap the rod member side end surface 79*c* of the nozzle member 79, with the lower end of the rod member 74 having been passed through the rod through-hole 77*b*.

Thus, the refrigerant diverter 70 functions as a vertically extending refrigerant inlet diverting section, having a refrigerant inlet section 70*a* in which the inlet space 78 is formed to let in refrigerant flowing in from the lower end side surface, and a refrigerant diverting section 70*b* in which the diverting space 75 is formed to divert the flow of refrigerant. The refrigerant diverter 70, which functions as a refrigerant inlet diverting section, is connected to the lower part of the inlet-outlet header 80 functioning as the refrigerant supply section 86, via a plurality of communication pipes (in this case, twelve) 88 which form a plurality of communication channels (in this case, twelve) 88A to 88L. In other words, the plurality of communication channels 88A to 88L are portions that guide refrigerant from the plurality of expelling spaces 76A to 76L configuring the refrigerant diverting section 70*b* to the plurality of supply spaces 86A to 86L of the refrigerant supply section 86. Thus, the lower part of the inlet-outlet header 80 functioning as the refrigerant supply section 86, the refrigerant diverter 70 functioning as a refrigerant inlet diverting section, and the plurality of communication pipes 88 forming the plurality of communication channels 88A to 88L function as a refrigerant diverting supply section 89 that causes the inflowing refrigerant to flow out to the plurality of heat transfer tubes 63 comprising flat tubes on the downstream side.

Taking the lowest positioned supply space 86A among the plurality of supply spaces 86A to 86L to be a lowest-level supply space, the communication channel 88A that among the plurality of communication channels 88A to 88L guides refrigerant to the lowest-level supply space 86A is taken to be the lowest-level communication channel, and the lowest positioned heat transfer tube among the heat transfer tubes 63 communicating with the lowest-level supply space 86A is taken to be a first heat transfer tube 63A1 that functions as a first flat tube; the first heat transfer tube 63A1 is disposed at a height position H2 included within the height range H1 of the inlet space 78, and the lowest-level communication channel 88A is disposed at a higher position H3 than the inlet space 78. In this embodiment, taking the highest positioned heat transfer tube among a predetermined number (in this case, two) of heat transfer tubes 63 communicating with the lowest-level supply space 86A to be a second heat transfer tube 63A2 that functions as a second flat tube, the lowest-level communication channel 88A is disposed at a height position H3 level with or higher than the height position H4 of the second heat transfer tube 63A2.

(7) Characteristics of the Refrigerant Diverter and the Outdoor Heat Exchanger

The refrigerant diverter 70 and the outdoor heat exchanger 23 of the present embodiment have characteristics such as the following.

<A>

In the refrigerant diverter 70 of the present embodiment, as described above, the vertically extending rod-shaped rod member 74 is disposed inside the diverter case 71, and the plurality of diverting channels 74A to 74L are configured from a plurality of holes extending in the longitudinal direction of the rod member 74 and integrally formed in the rod member 74.

Due to this type of rod member 74 being disposed inside the diverter case 71, a structure enabling the plurality of diverting channels 74A to 74L to be formed can be obtained with a small number of components, thereby facilitating production of the refrigerant diverter 70.

In the refrigerant diverter 70 of the present embodiment, as described above, the plurality of rod-side surface holes 74*a* are formed in the side surface of the rod member 74, and the plurality of expelling spaces 76A to 76L and the plurality of diverting channels 74A to 74L communicate through the plurality of rod-side surface holes 74*a*.

In the refrigerant diverter 70 of the present embodiment, as described above, the plurality of rod-side surface holes 74*a* are disposed in a helical array along the longitudinal direction of the rod member 74.

In the refrigerant diverter 70 of the present embodiment, as described above, the plurality of rod through-baffles 77, in which the rod through-holes 77*b* are formed for the rod member 74 to pass through, are inserted into the diverter case 71 from the side surface of the diverter case 71, and the plurality of expelling spaces 76A to 76L are formed by the plurality of rod through-baffles 77.

In the refrigerant diverter 70 of the present embodiment, as described above, the plurality of diverting channels 74A to 74L and the plurality of expelling spaces 76A to 76L have a one-to-one correspondence with each other.

<B>

In the refrigerant diverter 70 of the present embodiment, as described above, the nozzle member 79 in which the nozzle hole 79*b* is formed is provided to the diverter case 71 so as to partition the space inside the diverter case 71, which faces one longitudinal-directional end of the rod member 74, into the inlet space 78 which lets in the inflowing refrigerant and the diverting space 75 which guides the refrigerant to the plurality of diverting channels 74A to 74L. In the nozzle member 79, the nozzle recess 79*d*, which is a recessed portion larger in diameter than the nozzle hole 79*b*, is formed in the rod member side end surface 79*c* which is an end surface on one longitudinal end side of the rod member 74, and the diverting space 75 is configured from a space enclosed by the one longitudinal end of the rod member 74 and the nozzle recess 79*d* due to the one longitudinal end of the rod member 74 being brought into contact with the rod member side end surface 79*c*.

In this embodiment, the nozzle member 79, the inlet space 78, and the diverting space 75, which function as distributors, can be formed inside the diverter case 71, and the diverting space 75 can be formed in a state such that the one longitudinal end of the rod member 74 is brought into contact with the nozzle member 79. It is thereby possible in this case to make the size in the vertical direction smaller and the configuration more compact than a configuration in which the diverter case 71 and the distributors are provided separately.

In the refrigerant diverter 70 of the present embodiment, as described above, the to-be-entered part 74*b*, which is enclosed by the plurality of diverting channels 74A to 74L and which faces the nozzle hole 79*b*, is formed in one longitudinal end of the rod member 74, and the area of the to-be-entered part 74*b* is greater than the opening area of the nozzle hole 79*b*.

In this embodiment, it is easy to produce a flow that causes the refrigerant guided through the nozzle hole 79*b* from the inlet space 78 to the diverting space 75 to collide with the to-be-entered part 74*b*, and a gas-liquid mixture state of the refrigerant can be uniformly maintained. It is thereby possible in this case to facilitate equal guiding of the refrigerant to the plurality of diverting channels 74A to 74L from the diverting space 75.

In the refrigerant diverter 70 of the present embodiment, as described above, the nozzle recess 79*d* is formed so that the diameter grows larger in increments toward the one longitudinal end of the rod member 74.

In this case, it is easier to produce a flow that causes the refrigerant guided through the nozzle hole 79*b* from the inlet space 78 to the diverting space 75 to collide with the to-be-entered part 74*b*, and a gas-liquid mixture state of the refrigerant can be more uniformly maintained, more so than in a case in which the diameter of the nozzle recess 79*d* is sharply made greater than the nozzle hole 79*b*. It is thereby possible in this case to facilitate equal guiding of the refrigerant to the plurality of diverting channels 74A to 74L from the diverting space 75.

In the refrigerant diverter 70 of the present embodiment, as described above, the plurality of expelling spaces 76A to 76L disposed along the vertical direction are formed inside the diverter case 71. In the rod member 74, the plurality of diverting channels 74A to 74L are formed by a plurality of holes extending in the longitudinal direction of the rod member 74 and formed in the rod member 74. The plurality of rod-side surface holes 74*a* are formed in the side surface of the rod member 74, and the plurality of expelling spaces 76A to 76L and the plurality of diverting channels 74A to 74L communicate through the plurality of rod-side surface holes 74*a*.

In the refrigerant diverter 70 of the present embodiment, as described above, a rod through-baffle 77, in which a rod through-hole 77*b* is formed for the rod member 74 to pass through, is disposed as overlapping the rod member side end surface 79*c* of the nozzle member 79.

In this case, sideways positional misalignment of the rod member 74 and the nozzle member 79 can be prevented, and it is thereby possible to facilitate equal guiding of the refrigerant to the plurality of diverting channels 74A to 74L from the diverting space 75.

<C>

The refrigerant diverter 70 of the present embodiment is, in relation to the diverter case 71 (a vertically long and hollow case), a refrigerant passage component configured by inserting the nozzle member 79 (a plate-shaped holed plate member) in which the nozzle hole 79*b* (a hole through which refrigerant passes) is formed into the diverter case 71 from the side surface of the diverter case 71, as described above. In this case, the nozzle member 79 is provided so as to partition the space inside the diverter case 71 into the inlet space 78, which lets in the inflowing refrigerant, and the diverting space 75, which guides the refrigerant to the plurality of diverting channels 74A to 74L. The nozzle member 79 is made to move in the longitudinal direction of the diverter case 71 after having been inserted into the diverter case 71 via the insertion slit 72*c* formed in the side surface of the diverter case 71, and is thereby fitted into the diverter case 71 so as to be unable to move sideways in relation to the diverter case 71.

In this case, the nozzle hole 79*b* formed in the nozzle member 79 can be prevented from shifting out of the proper position, whereby the required flow of refrigerant, i.e., the required diverting performance can be achieved in the refrigerant diverter 70.

In the refrigerant diverter 70 of the present embodiment, as described above, the stepped part 79*e* protruding in the longitudinal direction of the diverter case 71 is formed on a surface of the nozzle member 79 that is located at one end along the longitudinal direction of the diverter case 71. When the nozzle member 79 is made to move in the longitudinal direction of the diverter case 71, a side surface 79*f* of the stepped part 79*e* comes into contact with the inner surface of the diverter case 71, whereby the nozzle member is fitted into the diverter case 71 so as to be unable to move sideways in relation to the diverter case 71.

In the refrigerant diverter 70 of the present embodiment, as described above, a rod through-baffle 77 is inserted into the insertion slit 72*c*, the rod through-baffle serving as a gap-filling member for filling in the gap formed after the nozzle member 79 has been made to move in the longitudinal direction of the diverter case 71.

In the refrigerant diverter 70 of the present embodiment, as described above, the nozzle member 79 and the rod through-baffle 77 serving as the gap-filling member are brazed together.

<D>

The outdoor heat exchanger 23, which functions as the refrigerant evaporator of the present embodiment, has the plurality of heat transfer tubes 63 comprising of flat tubes disposed along the vertical direction, and the refrigerant diverting supply section 89 for causing the inflowing refrigerant to flow out to the plurality of heat transfer tubes 63 on the downstream side, as described above. In this embodiment, the refrigerant diverting supply section 89 includes the lower part of the inlet-outlet header case 81 functioning as the refrigerant supply section 86, the refrigerant diverter 70 functioning as a refrigerant inlet diverting section, and the plurality of communication channels 88A to 88L. In the refrigerant supply section 86, which is a vertically extending portion, the plurality of heat transfer tubes 63 are sectioned along the vertical direction into the plurality of refrigerant paths 65A to 65L, each of which including a predetermined number of heat transfer tubes 63, and the plurality of supply spaces 86A to 86L that cause the refrigerant to flow out are formed. The refrigerant diverter 70 is a vertically extending portion having the refrigerant inlet section 70*a*, in which is formed the inlet space 78 for letting in refrigerant flowing in from the lower-end-side surface, and the refrigerant diverting section 70*b*, in which the diverting space 75 that diverts the flow of refrigerant is formed. The plurality of communication channels 88A to 88L constitute a portion that guides the refrigerant from the refrigerant diverting section 70*b* to the plurality of supply spaces 86A to 86L in the refrigerant supply section 86. Taking the lowest positioned supply space 86A among the plurality of supply spaces 86A to 86L to be a lowest-level supply space, the communication channel 88A that among the plurality of communication channels 88A to 88L guides refrigerant to the lowest-level supply space 86A is taken to be the lowest-level communication channel, and the lowest positioned heat transfer tube 63A1 among the heat transfer tubes 63 communicating with the lowest-level communication channel 86A is taken to be a first heat transfer tube that functions as a first flat tube, the first heat transfer tube 63A1 is disposed at a height position H2 included within the height range H1 of the inlet space 78, and the lowest-level communication channel 88A is disposed at a higher position H3 than the inlet space 78.

In this case, after the flow of the refrigerant in a gas-liquid mixture state flowing into the refrigerant diverter 70 from the lower-end-side surface has been equally diverted by the refrigerant diverting section 70*b*, the refrigerant can be guided through the lowest-level communication channel 88A to the lowest-level supply space 86A of the refrigerant supply section 86. It is thereby possible in this embodiment to ensure the performance of diverting the flow of refrigerant to the plurality of heat transfer tubes 63 including the first heat transfer tube 63A1 of the lowest-level supply space 86A, and to make, for example, the outdoor unit 2 of the air conditioning apparatus 1 suitable for installation on the bottom plate 52 of the unit casing 51.

In the outdoor heat exchanger 23, which functions as the refrigerant evaporator of the present embodiment, the inlet space 78 and the diverting space 75 are partitioned by the nozzle member 79 in which the nozzle hole 79*b* is formed, as described above.

In this embodiment, the height dimensions of the inlet space 78 and the diverting space 75 can be reduced, and the height position of the lowest-level communication channel 88A can be lowered.

In the outdoor heat exchanger 23, which functions as the refrigerant evaporator of the present embodiment, the nozzle recess 79*d*, which is a recessed portion larger in diameter than the nozzle hole 79*b*, is formed in the upper surface of the nozzle member 79, and the diverting space 75 is configured from the space formed by the nozzle recess 79*d*, as described above.

In this embodiment, the nozzle recess 79*d* formed in the nozzle member 79 makes it possible to reduce the height dimension of the diverting space 75, and to lower the height position of the lowest-level communication channel 88A.

In the outdoor heat exchanger 23, which functions as the refrigerant evaporator of the present embodiment, taking the highest positioned heat transfer tube 63A2 among the predetermined number of heat transfer tubes 63 communicating with the lowest-level supply space 86A to be the second heat transfer tube that functions as the second flat tube, the lowest-level communication channel 88A is disposed at a height position that is level with or higher than the second heat transfer tube 63A2 (i.e., H3≥H4).

In this embodiment, it is possible to hinder refrigerant from being easily let into the second heat transfer tube 63A2 among the flat tubes communicating with the lowest-level supply space 86A of the refrigerant supply section 86, and to equalize the refrigerant in a gas-liquid mixture state flowing to the flat tubes 63A1, 63A2 communicating with the lowest-level supply space 86A.

(8) Modifications

<A>

Figure 19:
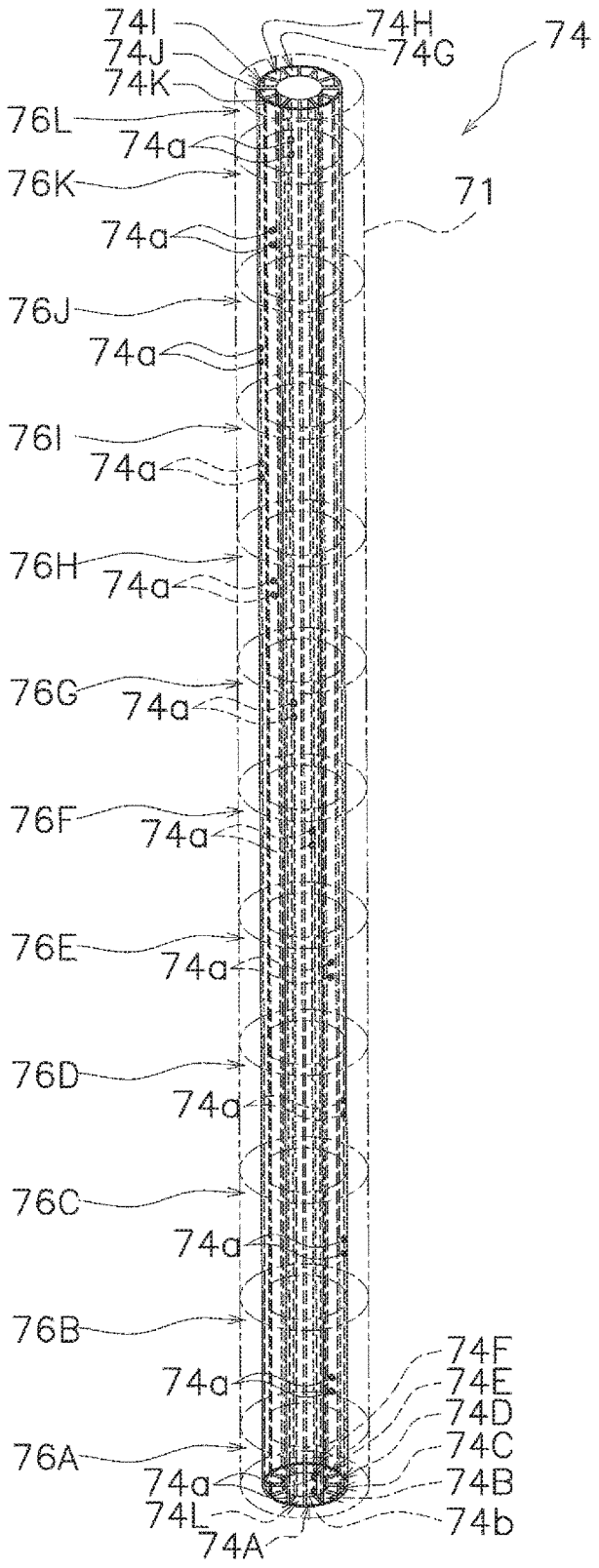
FIG. 19 shows a refrigerant diverter according to a modification, and corresponds to FIG. 11.

In the refrigerant diverter 70 according to the above embodiment, one rod-side surface hole 74*a* respectively enables communication between one of the plurality of diverting channels 74A to 74L and one of the plurality of expelling spaces 76A to 76L, but this arrangement is not provided by way of limitation. For example, each one of the plurality of diverting channels 74A to 74L and each one of the plurality of expelling spaces 76A to 76L may communicate through a plurality of rod-side surface holes (in this case, two for each) 74*a*, as shown in FIG. 19.

<B>

Figure 20:
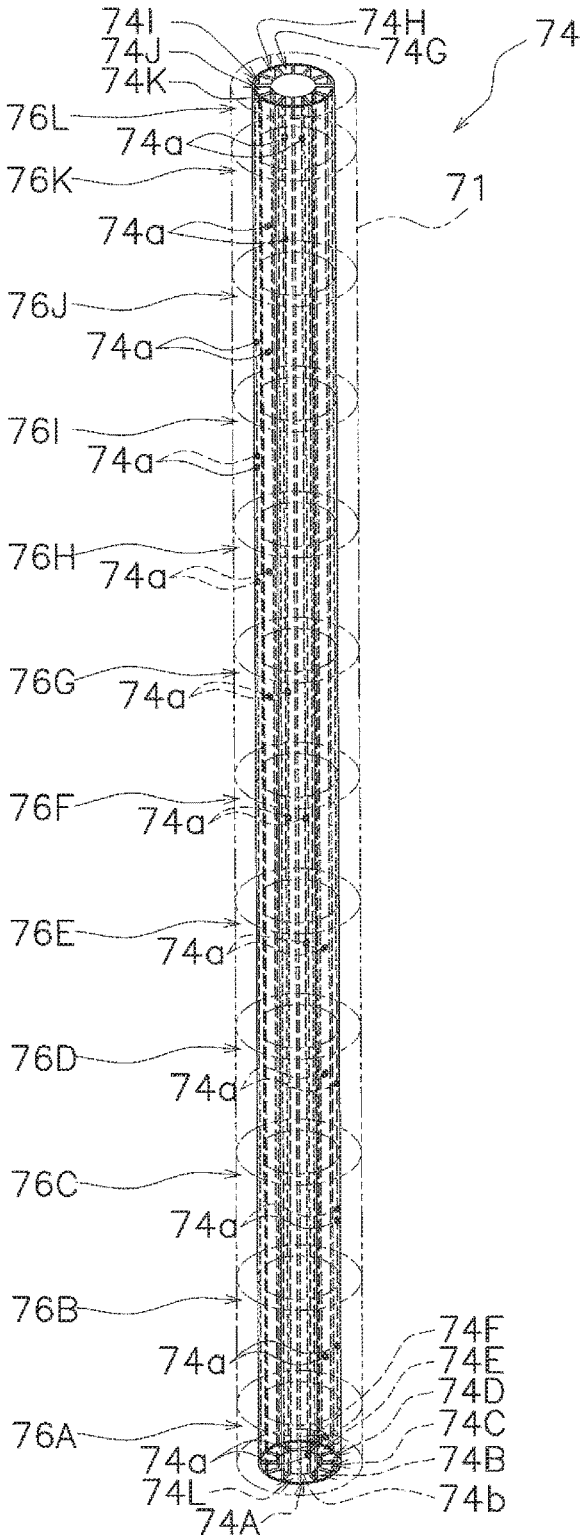
FIG. 20 shows a refrigerant diverter according to a modification, and corresponds to FIG. 11.

In the refrigerant diverter 70 according to the above embodiment, the plurality of diverting channels 74A to 74L and the plurality of expelling spaces 76A to 76L have a one-to-one correspondence with each other, but this arrangement is not provided by way of limitation. For example, the plurality of diverting channels 74A to 74L and the plurality of expelling spaces 76A to 76L may be configured as not having a one-to-one correspondence with each other, so that, for example, a configuration in which a rod-side surface hole 74*a* communicating with a plurality of diverting channels (in this case, two) is formed for one expelling space, or a configuration in which a rod-side surface hole 74*a* communicating with a plurality of expelling spaces (in this case, two), is formed for one diverting channel, as shown in FIG. 20.

<C>

Figure 21:
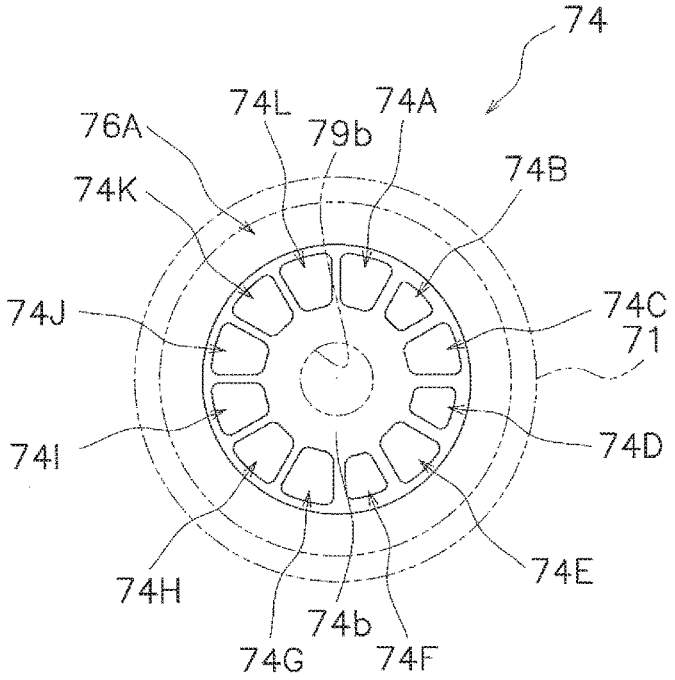
FIG. 21 shows a refrigerant diverter according to a modification, and corresponds to FIG. 12.

In the refrigerant diverter 70 according to the above embodiment, the plurality of diverting channels 74A to 74L all have the same opening sizes and the plurality of rod-side surface holes 74*a* all have the same diameters, but this arrangement is not provided by way of limitation. For example, the opening sizes of some of the diverting channels 74A to 74L may be different from those of other diverting channels (in this case, the opening sizes of the diverting channels 74B, 74D, 74F are smaller than those of the other diverting channels 74A, 74C, 74E, and 74G to 74L), as shown in FIG. 21.

By not forming any one of the plurality of diverting channels 74A to 74L of the rod member 74 or any one of the plurality of rod-side surface holes 74*a*, refrigerant need not be supplied to the corresponding expelling space may be precluded. By not connecting a communication pipe 88 to any one of the expelling spaces 76A to 76L, refrigerant need not be supplied to the corresponding supply space may be precluded. For example, when a space for preventing heat interference between the main heat exchange section 61L and the sub heat exchange section 62L is provided by not having refrigerant be supplied to the heat transfer tube 63 disposed in the border portion between the main heat exchange sections 61A to 61L and the sub heat exchange sections 62A to 62L, it is possible to employ either a structure in which the aforementioned diverting channel or rod-side surface hole is not formed, or a structure in which the communication pipe is not connected.

<D>

Figure 22:
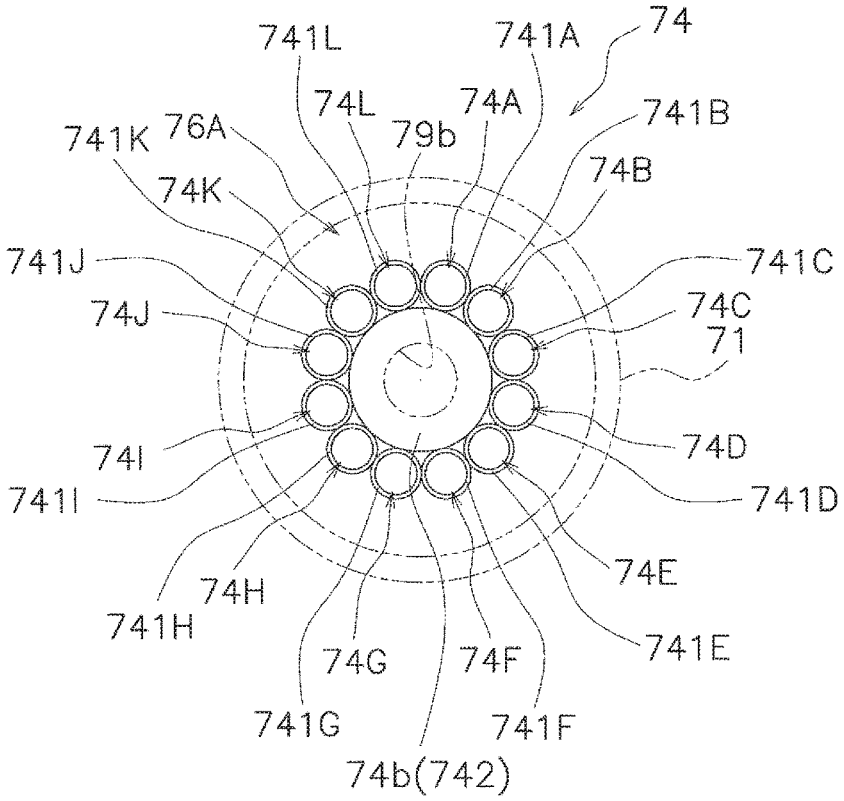
FIG. 22 shows a refrigerant diverter according to a modification, and corresponds to FIG. 12.
Figure 23:
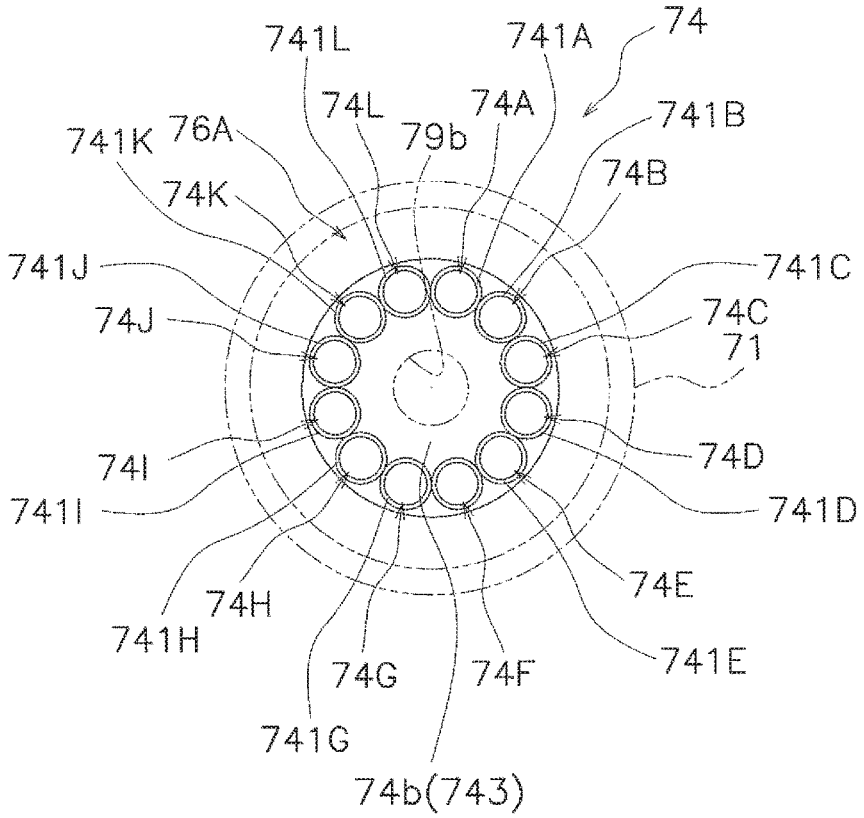
FIG. 23 shows a refrigerant diverter according to a modification, and corresponds to FIG. 12.

In the refrigerant diverter 70 according to the above embodiment, the rod member 74 is a vertically extending rod-shaped member in which the plurality of diverting channels 74A to 74L disposed along the circumferential direction are integrally formed, but this arrangement is not provided by way of limitation. For example, the rod member 74 may be configured by circumferentially forming a bundle of a plurality of thin pipe members (in this case, twelve) 741A to 741L that form the plurality of diverting channels 74A to 74L, as shown in FIGS. 22 and 23. Though not illustrated, a plurality of rod-side surface holes 74*a* are formed in the side surfaces of the plurality of thin pipe members 741A to 741L in the same manner as in the rod member 74 of the above embodiment, and the plurality of expelling spaces 76A to 76L and the plurality of diverting channels 74A to 74L communicate through the plurality of rod-side surface holes 74*a*. A center rod 742 may be provided as shown in FIG. 22 in the portion enclosed by the plurality of thin pipe members 741A to 741L, and the lower end of the center rod 742 may serve as the to-be-entered part 74*b*. Instead of the center rod 742, a partitioning body 743 through which the plurality of thin pipe members 741A to 741L can pass may be provided to the lower ends of the plurality of thin pipe members 741A to 741L as shown in FIG. 23, and the center portion of the partitioning body 743 may serve as the to-be-entered part 74*b*.

<E>

Figure 24:
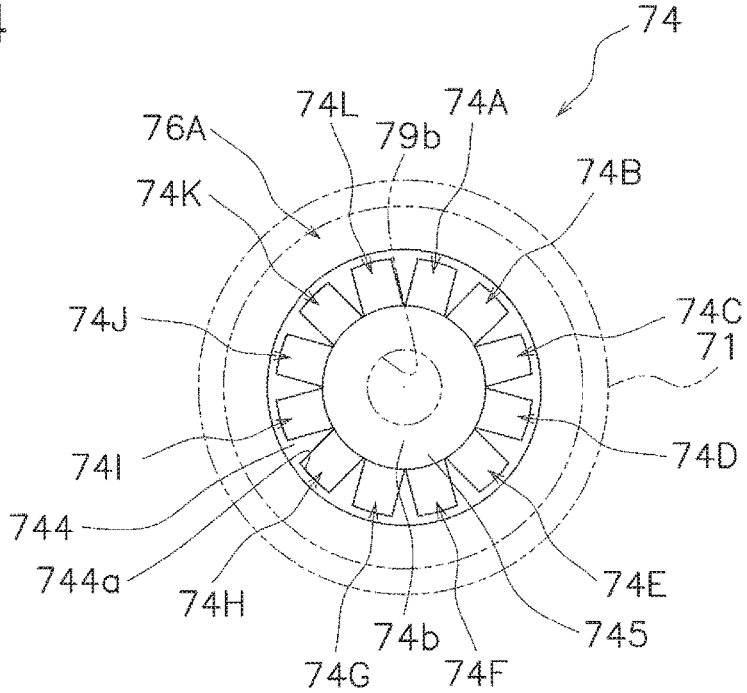
FIG. 24 shows a refrigerant diverter according to a modification, and corresponds to FIG. 12.
Figure 25:
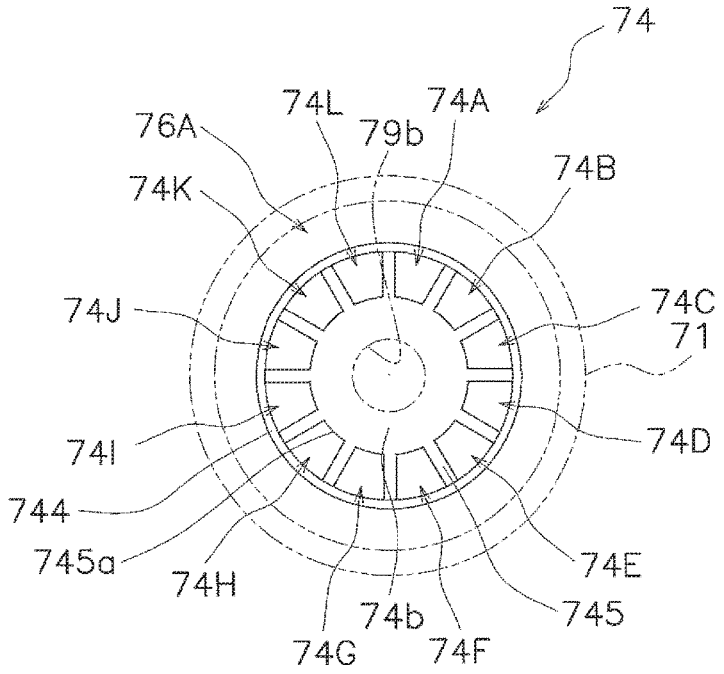
FIG. 25 shows a refrigerant diverter according to a modification, and corresponds to FIG. 12.

In the refrigerant diverter 70 according to the above embodiment, the rod member 74 is a vertically extending rod-shaped member in which the plurality of diverting channels 74A to 74L extending along the circumferential direction are integrally formed, but this arrangement is not provided by way of limitation. For example, the rod member 74 may be configured by a tubular outer rod member 744 and an inner rod member 745 disposed on the inner peripheral side of the outer rod member 744, as shown in FIGS. 24 and 25. In this case, a plurality of grooves (in this case, twelve) 744*a*, 745*a* extending in the longitudinal direction of the rod member 74 are formed in the inner peripheral surface of the outer rod member 744 and/or in the outer peripheral surface of the inner rod member 745, and the plurality of diverting channels 74A to 74L are formed by the spaces enclosed by the plurality of grooves 744*a*, 745*a* and either the inner peripheral surface of the outer rod member 744 or the outer peripheral surface of the inner rod member 745. Though not illustrated here, a plurality of rod-side surface holes 74*a* are formed in the side surface of the outer rod member 744 in the same manner as in the rod member 74 of the above embodiment, and the plurality of expelling spaces 76A to 76L and the plurality of diverting channels 74A to 74L communicate through the plurality of rod-side surface holes 74*a*. In this case, the middle portion of the lower end of the inner rod member 745 serves as the to-be-entered part 74*b*.

<F>

In the outdoor heat exchanger 23, which functions as the refrigerant evaporator according to the above embodiment, the refrigerant supply section 86 is formed in the vertically extending inlet-outlet header case 81, the refrigerant inlet diverting section (in this case, the refrigerant diverter 70) is formed in the vertically extending diverter case 71, and the inlet-outlet header case 81 and the diverter case 71 are connected via the plurality of communication pipes 88 that form the plurality of communication channels 88A to 88L, but this arrangement is not provided by way of limitation.

For example, though not illustrated here, the refrigerant supply section 86, the refrigerant diverter 70, and the plurality of communication channels 88A to 88L may be formed in a single vertically extending header-and-diverter case (e.g., the lower part of the inlet-outlet header case 81).

Figure 26:
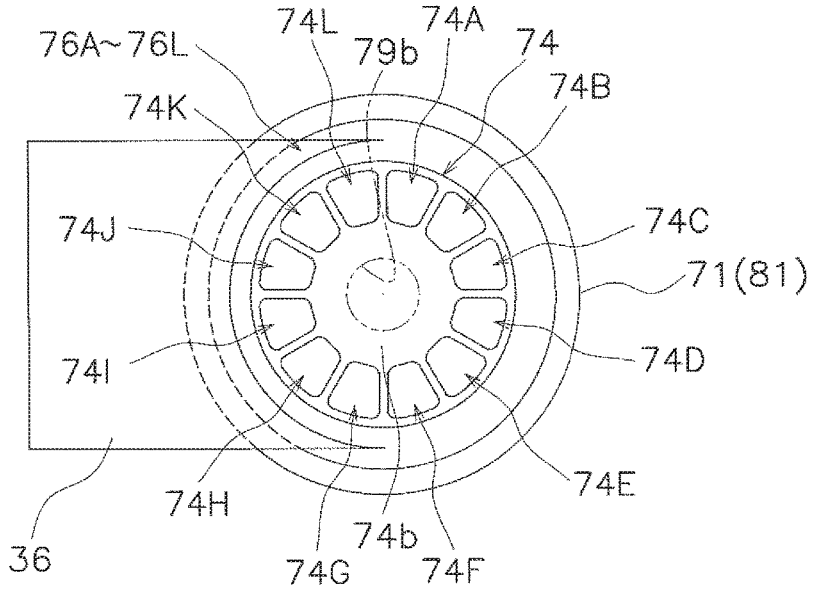
FIG. 26 shows a refrigerant diverter according to a modification, and shows a structure in which heat transfer tubes are made to communicate directly with expelling spaces.

When the refrigerant inlet diverting section 70 is formed in the lower part of the inlet-outlet header case 81, the refrigerant supply section 86 and the plurality of communication channels 88A to 88L may be omitted, and the heat transfer tubes 63 may be made to communicate directly with the plurality of expelling spaces 76A to 76L. At this time, the distal end parts of the heat transfer tubes 63 may be formed so as to avoid to the rod member 74, as shown in FIG. 26.

<G>

Figure 27:
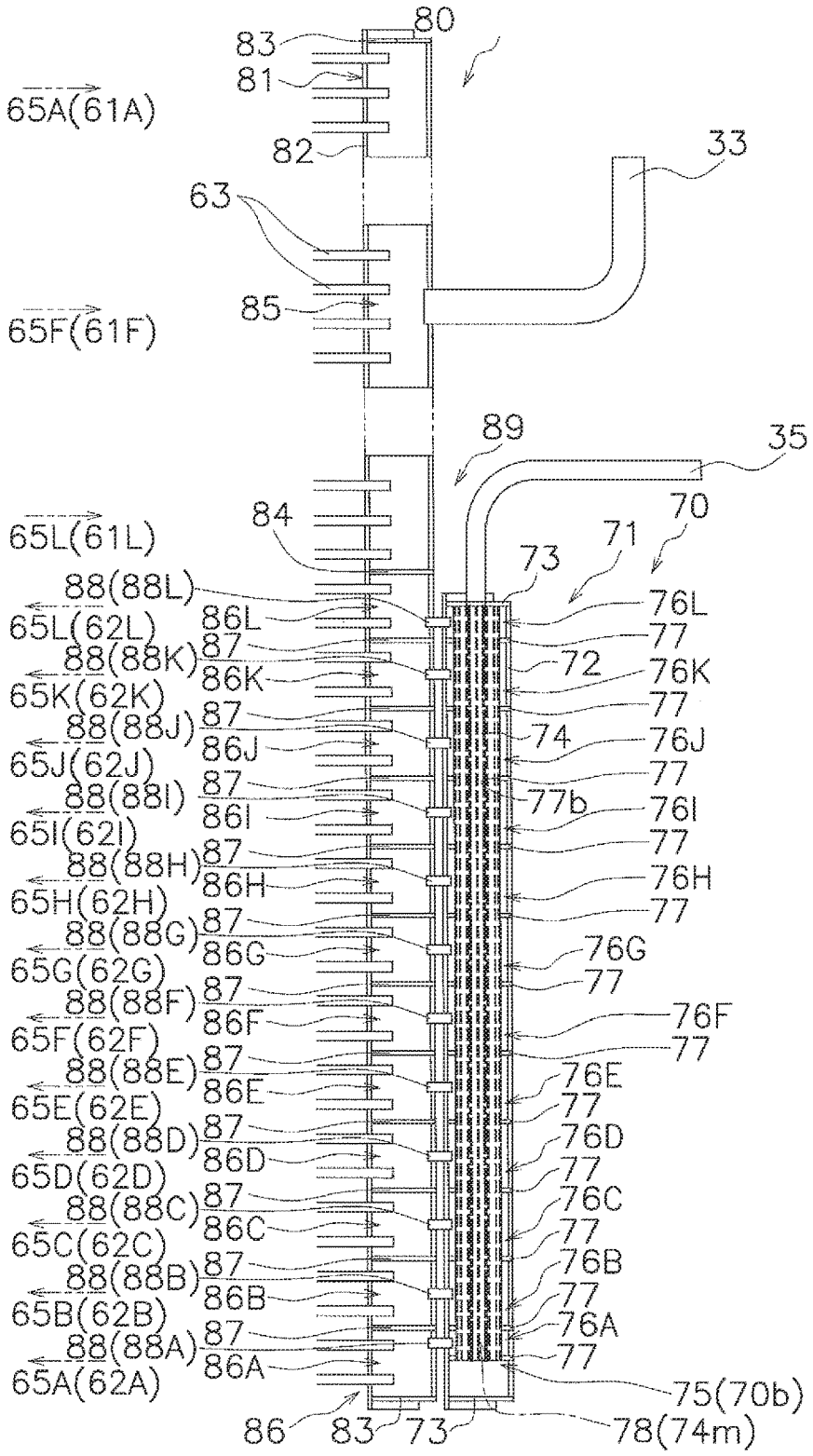
FIG. 27 shows a refrigerant diverter according to a modification, and corresponds to FIG. 9.

In the refrigerant diverter 70 according to the above embodiment, the interior of the diverter case 71 is configured so that the rod member 74 is disposed in the upper part thereof, the nozzle member 79 is disposed in the lower part thereof, and the refrigerant is let in from the lower end of the diverter case 71, but this arrangement is not provided by way of limitation. For example, a configuration may be adopted such that, in the interior of the diverter case 71, the rod member 74 is disposed in the lower part thereof, the nozzle member 79 is disposed in the upper part thereof, and the refrigerant is let in from the upper end of the diverter case 71. At this time, a center through-hole 74*m*, which passes vertically through the center of the rod member 74 may be formed, and refrigerant may be channeled from the upper part of the diverter case 71 to the lower part via the center through-hole 74*m*, as shown in FIG. 27. In this case, the nozzle member 79 is unnecessary because the diverting function is fulfilled due to the refrigerant colliding with the lower part of the diverter case 71.

<H>

Figure 28:
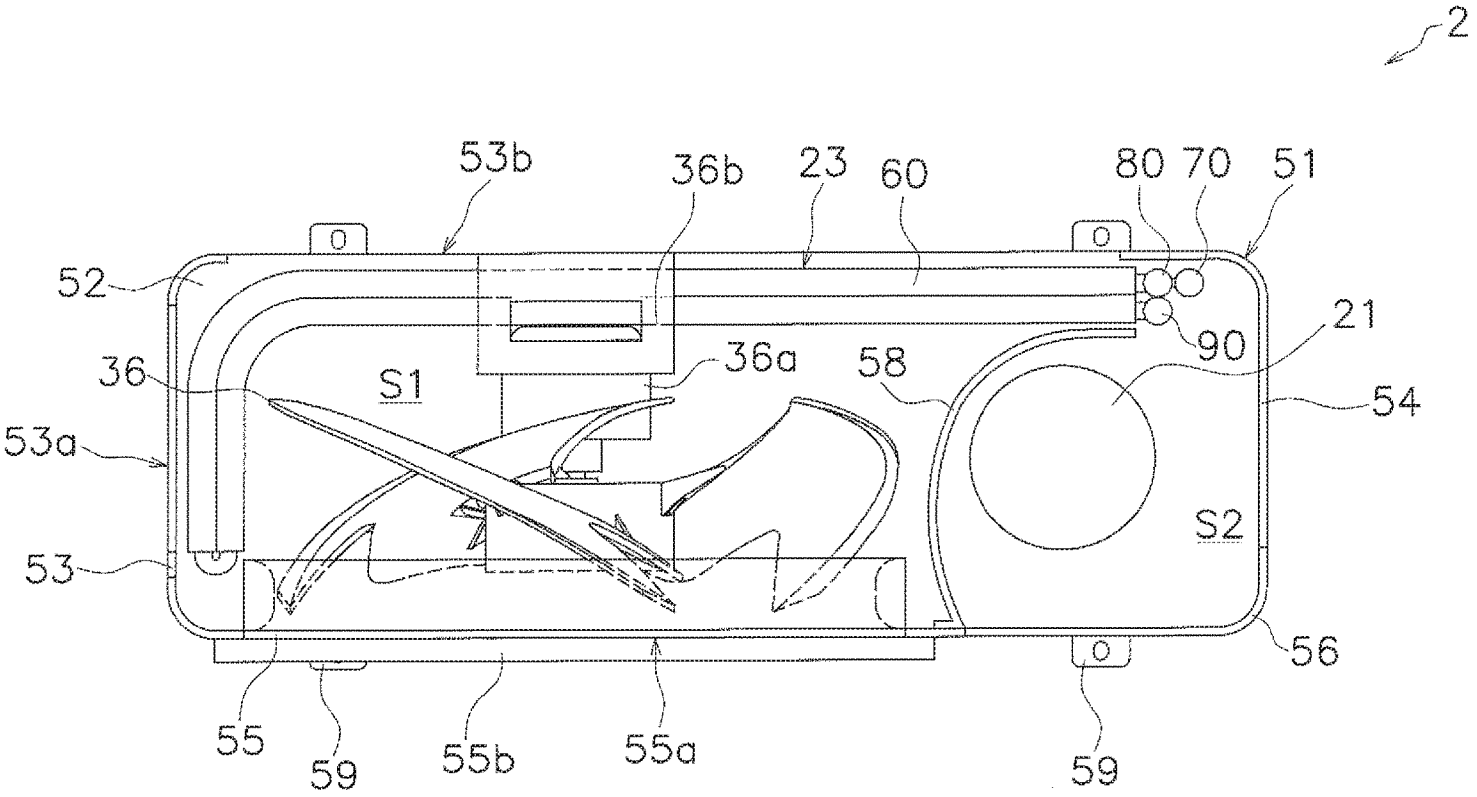
FIG. 28 is a plan view showing an outdoor unit having an outdoor heat exchanger according to a modification, with the top plate removed.

In the outdoor heat exchanger 23 according to the above embodiment, the description used as an example a configuration in which a plurality of the heat transfer tubes 63 comprising of flat tubes were disposed along the vertical direction in only one row as seen in a plan view, but this arrangement is not provided by way of limitation. For example, the configuration may have two rows of heat transfer tubes 63 as seen in a plan view, each row containing a plurality of tubes disposed along the vertical direction, as shown in FIG. 28. In this case, the other longitudinal-direction end (the left end) of the heat transfer tubes 63 turns back toward the one longitudinal-direction end (the right end); therefore, not only the refrigerant diverter 70 and the inlet-outlet header 80 but also the intermediate header 90 are provided on the one end (the right end) side of the heat transfer tubes 63.

INDUSTRIAL APPLICABILITY

The present invention is widely applicable in refrigerant diverters in which a plurality of diverting channels disposed along a circumferential direction are formed inside a vertically extending diverter case.

What is claimed is:

1. A refrigerant diverter configured to divert a flow of refrigerant and to guide the flow of refrigerant to a downstream side of the flow of refrigerant, the refrigerant diverter comprising:

a vertically extending diverter case including a cylindrical body, the cylindrical body having formed inside thereof a plurality of diverting channels disposed along a circumferential direction, a diverting space arranged to guide the flow of refrigerant to the diverting channels, and a plurality of expelling spaces that communicate with the diverting space through the diverting channels, the expelling spaces being disposed along a vertical direction;

a vertically extending rod-shaped rod member disposed inside the cylindrical body of the diverter case; and a nozzle member disposed in the vertically extending diverter case, the nozzle member having a nozzle hole arranged to partition a space facing an end of the rod member in the longitudinal direction into an inlet space for the flow of refrigerant and the diverting space, and a nozzle recess formed in an end surface of the nozzle member facing the end of the rod member in the longitudinal direction, the nozzle recess having a larger diameter than the nozzle hole, the diverting channels being configured from a plurality of holes extending in a longitudinal direction of the rod member and integrally formed in the rod member, the diverting space being a space enclosed by the end of the rod member in the longitudinal direction and the nozzle recess in a state in which the end of the rod member in the longitudinal direction contacts the end surface of the nozzle member.

2. The refrigerant diverter according to claim 1, wherein a plurality of rod-side surface holes are formed in a side surface of the rod member, and the expelling spaces and the diverting channels communicate through the rod-side surface holes.

3. The refrigerant diverter according to claim 2, wherein the rod-side surface holes are disposed in a helical array along the longitudinal direction of the rod member.

4. The refrigerant diverter according to claim 1, wherein a plurality of rod through-baffles are inserted into the diverter case from a side surface of the diverter case, the rod through-baffles have rod through-holes formed therein arranged to have the rod member pass through, and the expelling spaces are formed by the rod through-baffles.

5. The refrigerant diverter according to claim 1, wherein the diverting channels and the expelling spaces have a one-to-one correspondence with each other.

6. The refrigerant diverter according to claim 2, wherein a plurality of rod through-baffles are inserted into the diverter case from a side surface of the diverter case, the rod through-baffles have rod through-holes formed therein arranged to have the rod member pass through, and the expelling spaces are formed by the rod through-baffles.

7. The refrigerant diverter according to claim 2, wherein the diverting channels and the expelling spaces have a one-to-one correspondence with each other.

8. The refrigerant diverter according to claim 3, wherein a plurality of rod through-baffles are inserted into the diverter case from a side surface of the diverter case, the rod through-baffles have rod through-holes formed therein arranged to have the rod member pass through, and the expelling spaces are formed by the rod through-baffles.

9. The refrigerant diverter according to claim 3, wherein the diverting channels and the expelling spaces have a one-to-one correspondence with each other.

10. The refrigerant diverter according to claim 4, wherein the diverting channels and the expelling spaces have a one-to-one correspondence with each other.

* * * * *